US012733749B2

(12) United States Patent
Leng

(10) Patent No.: US 12,733,749 B2
(45) Date of Patent: Sep. 15, 2026

(54) ELASTIC CONNECTION STRUCTURE, ROW OF SPRINGS, ELASTIC MATTRESS, AND METHOD FOR USING ELASTIC MATTRESS

(71) Applicant: Luhao Leng, Xiamen City (CN)

(72) Inventor: Luhao Leng, Xiamen City (CN)

( * ) Notice: Subject to any disclaimer, the term of this patent is extended or adjusted under 35 U.S.C. 154(b) by 15 days.

(21) Appl. No.: 18/757,225

(22) Filed: Jun. 27, 2024

(65) Prior Publication Data

US 2025/0288121 A1 Sep. 18, 2025

(30) Foreign Application Priority Data

Mar. 15, 2024 (CN) ..... 202410298349.1

(51) Int. Cl.
*A47C 27/045* (2006.01)

(52) U.S. Cl.
CPC ..... *A47C 27/0456* (2013.01)

(58) Field of Classification Search
CPC ... A47C 23/05; A47C 23/005; A47C 23/0438; A47C 23/002
See application file for complete search history.

(56) References Cited

U.S. PATENT DOCUMENTS

| | | | | |
|---|---|---|---|---|
| 2017/0340129 | A1* | 11/2017 | Leng | A47C 23/005 |
| 2018/0027976 | A1* | 2/2018 | Leng | A47C 19/005 |
| 2019/0090652 | A1* | 3/2019 | Leng | A47C 27/20 |
| 2022/0000271 | A1 | 1/2022 | Nguyen | |
| 2022/0346556 | A1* | 11/2022 | Leng | A47C 23/05 |

FOREIGN PATENT DOCUMENTS

| | | | | |
|---|---|---|---|---|
| CN | 107569000 | A | 1/2018 | |
| CN | 112674535 | A | 4/2021 | |
| CN | 112674537 | A | 4/2021 | |
| CN | 112674539 | A | 4/2021 | |
| CN | 112674540 | A | 4/2021 | |
| CN | 112674541 | A | 4/2021 | |
| CN | 112674543 | A | 4/2021 | |
| CN | 115670171 | A * | 2/2023 | A47C 27/07 |

(Continued)

OTHER PUBLICATIONS

Trans CN-115670171-A (Year: 2026).*

(Continued)

*Primary Examiner* — J. T. Newton
(74) *Attorney, Agent, or Firm* — Cooper Legal Group, LLC

(57) ABSTRACT

A spring connecting structure includes one or more elastic modules and one or more mounting frames, the one or more mounting frames comprise a plurality of longitudinal extending portions, the one or more elastic modules comprise one or more upper covers and one or more bases, the one or more bases of the one or more elastic modules comprise one or more sliding paths, the plurality of longitudinal extending portions comprise a plurality of mounting portions, and the plurality of mounting portions comprise one or more mounting sliding rails and one or more positioning portions to enable the one or more elastic modules to be positioned at a mount position. A distance between two adjacent mounting sliding rails is greater than a size of a corresponding upper cover, and the one or more sliding paths cooperate with and are positioned at the one or more mounting sliding rails.

22 Claims, 22 Drawing Sheets

(56) References Cited

FOREIGN PATENT DOCUMENTS

| | | | | | |
|---|---|---|---|---|---|
| CN | 115813148 | A | | 3/2023 | |
| CN | 116172360 | A | | 5/2023 | |
| CN | 116369699 | A | | 7/2023 | |
| CN | 222031953 | U | | 11/2024 | |
| CN | 120154207 | A | * | 6/2025 | ..... A47C 27/063 |
| CN | 120643068 | A | * | 9/2025 | ..... A47C 27/07 |
| EP | 4292478 | A1 | | 12/2023 | |
| KR | 20200071963 | A | | 6/2020 | |

OTHER PUBLICATIONS

Trans CN-120154207-A (Year: 2026).*
Trans. CN-120643068-A (Year: 2026).*
EP Office Action cited in EP24188142.4, mailed Jan. 8, 2025, 5 pages.
EP Search Report cited in EP24188142.4,, mailed Dec. 16, 2024, 4 pages.
International Search Report cited in PCT/CN2025/082568, mailed Jun. 4, 2025, 8 pages.
Written Opinion cited in PCT/CN2025/082568, mailed Jun. 4, 2025, 9 pages.

* cited by examiner

ELASTIC CONNECTION STRUCTURE, ROW OF SPRINGS, ELASTIC MATTRESS, AND METHOD FOR USING ELASTIC MATTRESS

RELATED APPLICATIONS

This application claims priority to Chinese patent application number 202410298349.1, filed on Mar. 15, 2024. Chinese patent application number 202410298349.1 is incorporated herein by reference.

FIELD OF THE DISCLOSURE

The present disclosure relates to the field of furniture, and in particular relates to a spring connecting structure, a row of springs, and an elastic mattress and a method thereof.

BACKGROUND OF THE DISCLOSURE

Bed mattresses are essential furniture in beddings for human use in modern life. Elastic bed mattresses with a middle part having elastic components are becoming increasingly popular for relaxation during sleep with increasing pressure in human lives. The existing elastic components of the elastic bed mattress mostly use springs packaged in independent pockets, i.e., each of the springs is individually packaged in a spring pocket of the independent pockets, the springs packaged in the independent pockets are arranged in a pattern and then covered using a whole piece of foam rubber to form the elastic bed mattress. This elastic bed mattress cannot be disassembled and cannot be easily transported, resulting in difficulty in disassembling and assembling a bed when people move houses or in other situations where the bed needs to be moved. At the same time, fabrics and soft cushions of the bed mattress cannot be disassembled and cleaned, leading to affecting human health caused by breeding of mites after a long time. Further, when the bed mattress is subjected to stress, the springs packaged in the independent pockets cannot completely independently move up and down to fit curves of a human body, thus affecting comfort.

Detachable elastic components are installed in the bed mattress, so that the bed mattress can be disassembled when needed, a difficulty for transporting the bed mattress is reduced, and the furniture can be cleaned and replaced regularly. However, in the existing detachable elastic mattress, stress stability of springs is low, and a detachable connection between the springs and a mounting rack is not firm, resulting in the bed mattress being not stable enough in use, having poor durability, and having a shortened service life.

BRIEF SUMMARY OF THE DISCLOSURE

A main technical problem solved by the present disclosure is to provide a spring connecting structure. One or more elastic modules and a mounting rack can be detachably assembled, so that an elastic mattress, such as a bed mattress, comprising the spring connecting structure can be detached, thereby facilitating transportation, relocation, and cleaning of the elastic mattress. At the same time, the spring connecting structure has strong stability and is firmly mounted on the mounting rack, so that the elastic mattress, such as the bed mattress or a sofa, is more stable in use, has high repeatability in disassembly, is more durable, and has a longer service life.

In order to solve the aforementioned technical problems, the present disclosure provides a spring connecting structure, the spring connecting structure comprises a mounting rack and one or more elastic modules. The mounting rack comprises one or more mounting frames, the one or more mounting frames comprise a plurality of longitudinal extending portions and one or more connecting portions, the one or more connecting portions are disposed between the plurality of longitudinal extending portions and disposed between the plurality of longitudinal extending portions and one or more side beams of the one or more mounting frames, the one or more elastic modules comprise one or more upper covers and one or more bases, the one or more upper covers are used as one or more supporting surfaces, the one or more bases are used as one or more connecting ends to be connected to the one or more mounting frames, the one or more bases of the one or more elastic modules comprise one or more sliding paths, the plurality of longitudinal extending portions comprise a plurality of mounting portions, and the plurality of mounting portions comprise one or more mounting sliding rails and one or more positioning portions to enable the one or more elastic modules to be positioned at a mount position.

A distance between two adjacent mounting sliding rails of the one or more mounting sliding rails on the mounting rack is greater than a size of a corresponding one of the one or more upper covers of the one or more elastic modules, and the one or more sliding paths cooperate with and are positioned at the one or more mounting sliding rails to enable the one or more elastic modules to be detachably mounted on the one or more mounting frames.

In some embodiments, one or more sliding sections configured to cooperate with the one or more sliding paths in a stay-away way are disposed on first ends of the one or more mounting sliding rails to enable the one or more sliding paths to be placed on the one or more sliding sections in a vertical direction and then slide horizontally into the one or more mounting sliding rails.

In some embodiments, the plurality of longitudinal extending portions are strips extending longitudinally.

In some embodiments, each of the one or more mounting sliding rails is a T-shaped sliding rail formed by lateral protrusions on two sides of a corresponding one of the strips along a width direction.

In some embodiments, the one or more sliding paths comprises a positioning slot configured to cooperate with the lateral protrusions, and the positioning slot is positioned at and cooperates with the lateral protrusions in the vertical direction and a width direction of the positioning slot.

In some embodiments, a width of a corresponding one of the one or more sliding sections is smaller than a width of the T-shaped sliding rail.

In some embodiments, each of the one or more mounting sliding rails is T-shaped sliding rails formed by vertical protrusions on two sides of a corresponding one of the plurality of mounting portions.

In some embodiments, each of the one or more sliding paths comprises two strip-shaped slots configured to cooperate with two corresponding vertical protrusions of the vertical protrusions.

In some embodiments, the T-shaped sliding rails comprises sharp ends adjacent to the one or more sliding sections to facilitate the one or more sliding paths of the one or more elastic modules sliding into the T-shaped sliding rails.

In some embodiments, each of the one or more sliding sections comprises a groove with a width greater than a distance between the T-shaped sliding rails in the corresponding one of the plurality of mounting portions.

In some embodiments, each of the one or more positioning portions is a groove wall of an end of the groove in a sliding-in direction of a corresponding one of the mounting sliding rails.

In some embodiments, one or more centers of the one or more bases of the one or more elastic modules comprise one or more openings.

In some embodiments, an insertion member is disposed between the T-shaped sliding rails in the corresponding one of the plurality of mounting portions, the insertion member comprises a fixed end and an elastic end, the fixed end is fixedly connected to a corresponding one of the plurality of longitudinal extending portions, the elastic end is configured to swing from an initial position to a second position due to an external force, when the elastic end is in the initial position, the elastic end is connected to a corresponding one of the one or more openings, and when the elastic end is in the second position, the elastic end is separated from the corresponding one of the one or more openings.

In some embodiments, the elastic end has a slope with a height gradually increasing along a direction in which a corresponding one of the one or more sliding paths slide into a corresponding one of the one or more mounting sliding rails.

In some embodiments, the insertion member configured to be inserted into a corresponding one of the one or more bases of the one or more elastic modules defines a corresponding one of the one or more positioning portions.

In some embodiments, the one or more elastic modules define inverted tapered shapes, and an area of each of the one or more upper covers of the one or more elastic modules is larger than an area of a corresponding base of the one or more bases of the one or more elastic modules.

In some embodiments, the one or more elastic modules are a plurality of elastic modules, the one or more upper covers is a plurality of upper covers, the plurality of elastic modules define a row of springs in which the plurality of upper covers of the one or more upper covers in the plurality of elastic modules are connected together, and a number of the plurality of elastic modules in the row of springs is the same as a number of the plurality of mounting portions on the one or more mounting frames.

In some embodiments, a connection between the plurality of upper covers in the plurality of elastic modules is a flexible connection.

In some embodiments, the one or more mounting frames is a plurality of mounting frames, and the row of springs on a first mounting frame of the plurality of mounting frames are detachably connected to the row of springs on a second mounting frame of the plurality of mounting frames.

In some embodiments, the one or more connecting portions are a mesh structure having a symmetrical structure.

In some embodiments, the one or more mounting frames comprise a plurality of mounting frames, and the plurality of mounting frames are detachably connected to each other.

In some embodiments, a first side beam of the one or more side beams on a first mounting frame of the plurality of mounting frames comprises at least one of a first positioning protrusion or a first positioning groove, a second side beam of the one or more side beams on a second mounting frame of the plurality of mounting frames comprises at least one of a second positioning protrusion or a second positioning groove, and the at least one of the first positioning protrusion or the first positioning groove and the at least one of the second positioning protrusion or the second positioning groove on the first side beam and the second side beam cooperate with each other to enable the plurality of mounting frames to be detachably connected to each other.

In some embodiments, the plurality of mounting frames are connected together in a length direction of the mounting rack to form a plurality of spliced bodies, and the plurality of spliced bodies are connected in a width direction of the mounting rack to form a rectangular mounting rack.

In some embodiments, the one or more mounting frames comprise a plurality of mounting frames, and the plurality of mounting frames are foldable relative to each other.

The present disclosure discloses a row of springs, the row of springs comprises at least two of the one or more elastic modules, the one or more elastic modules comprise one or more connecting straps and one or more springs abutting the one or more bases and the one or more upper covers, and the one or more upper covers of the at least two of the one or more elastic modules are connected together.

In some embodiments, the one or more elastic modules define inverted tapered shapes, and an area of each of the one or more upper covers of the one or more elastic modules is larger than an area of a corresponding base of the one or more bases of the one or more elastic modules.

In some embodiments, a connection between the one or more upper covers of the one or more elastic modules of the row of springs is a flexible connection.

The present disclosure discloses an elastic mattress, and the elastic mattress comprises one or more of the spring connecting structures.

The present disclosure discloses a method for using the elastic mattress, the method comprises using the elastic mattress using the one or more of the spring connecting structures in a sofa, a bed mattress, a soft package, etc.

Compared with the existing technologies, the present disclosure has the following advantages.

1. The one or more elastic modules of the spring connecting structure provided by the present disclosure can be detachably mounted on the one or more mounting frames through a clamping engagement of the one or more sliding paths and the one or more mounting sliding rails. The one or more mounting sliding rails are separately disposed to enable the one or more elastic modules to be neatly mounted without affecting each other. Therefore, the elastic mattress using the spring connecting structure can be disassembled and assembled to facilitate transportation and relocation, and the elastic mattress using the spring connecting structure can be firmly mounted, be used with high stability, be more durable, and have a longer service life.

2. Each of the one or more mounting frames of the mounting rack of the spring connecting structure provided by the present disclosure can be disassembled or folded, and the one or more mounting frames can be stacked together at will to save transportation space.

3. The one or more elastic modules of the spring connecting structure provided by the present disclosure can be connected together, which strengthens stability of the one or more elastic modules on the one or more mounting frames and improves stability and firmness of the elastic mattress.

DETAILED DESCRIPTION OF THE EMBODIMENTS

Figure 1:
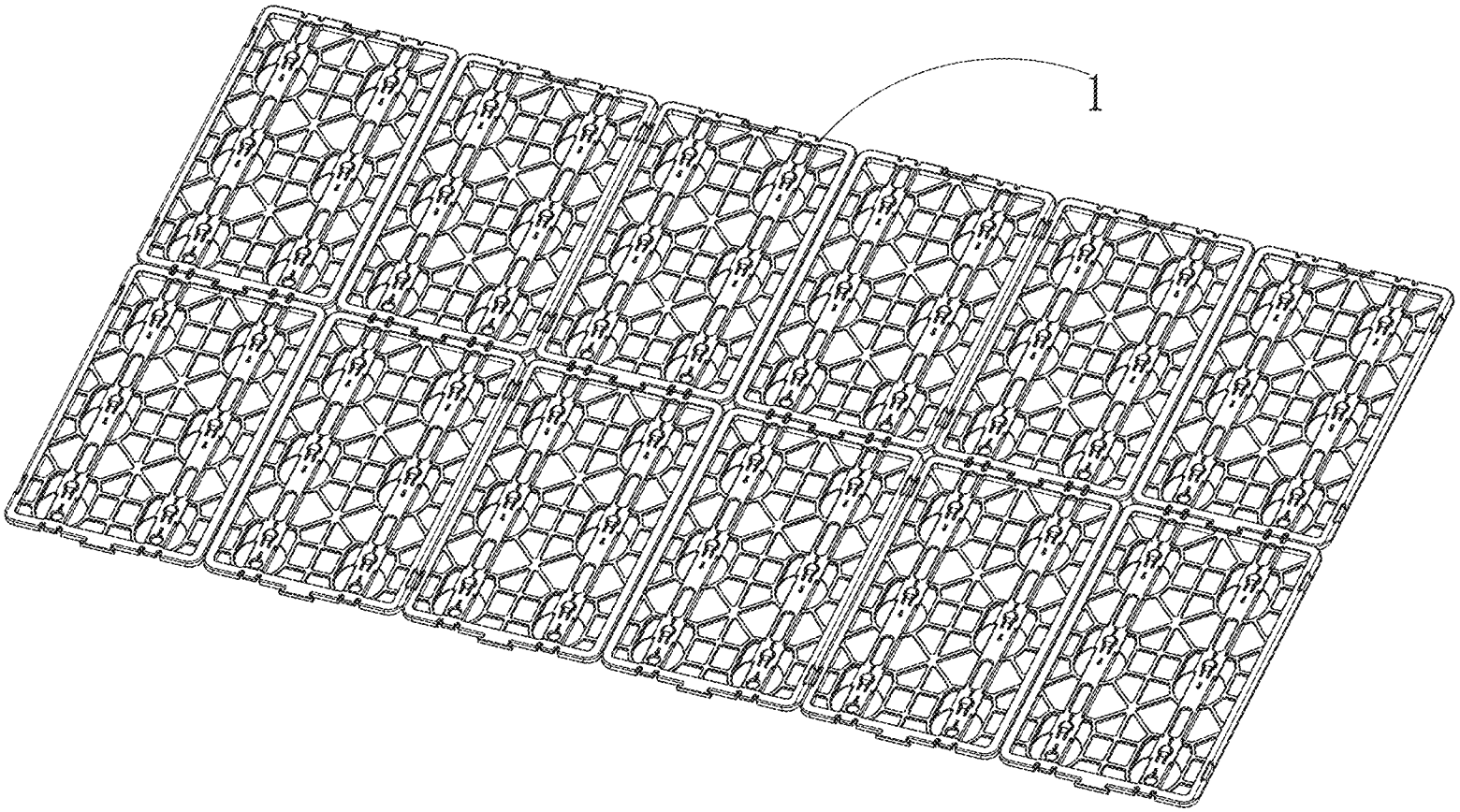
FIG. 1 is a diagrammatic view of a mounting rack in Embodiment 1.

The technical solutions in the embodiments of the present disclosure will be clearly and completely described in combination with the accompanying drawings in the embodiments of the present disclosure. It is obvious that the described embodiments are merely some embodiments instead of all embodiments of the present disclosure. All other embodiments fall within the protection scope of the present disclosure provided that they are obtained by technical person skilled in the art based on the embodiments of the present disclosure without creative works.

In the description of the present disclosure, it is noted that terms, such as "upper", "lower", "inner", "outer", "top", and "bottom" indicate orientations or positional relationships based on orientations and positional relationships shown in the drawings, so as to easily describe the present disclosure and simplify the description, rather than indicating or implying that the referenced device or element should have a specific orientation or be constructed and operated in a specific orientation and therefore should not be understood as a limitation of the present disclosure. In addition, terms "first" and "second" are merely used for the description and should not be understood to indicate or imply relative importance.

In the description of the present disclosure, unless otherwise expressly required and limited, it should be noted that terms such as "installed", "disposed", "sleeved", "socketed", and "connected", should develop broad understanding. For example, "connected" can be a wall-mountable connection, a detachable connection, or an integrated connection, a mechanical connection, an electrical connection, a direct connection, an indirect connection through an intermediator, or communication between inner portions of two members. For technical person skilled in the art, specific meaning of the terms in the present disclosure can be understood under specific conditions.

Embodiment 1

Figure 2:
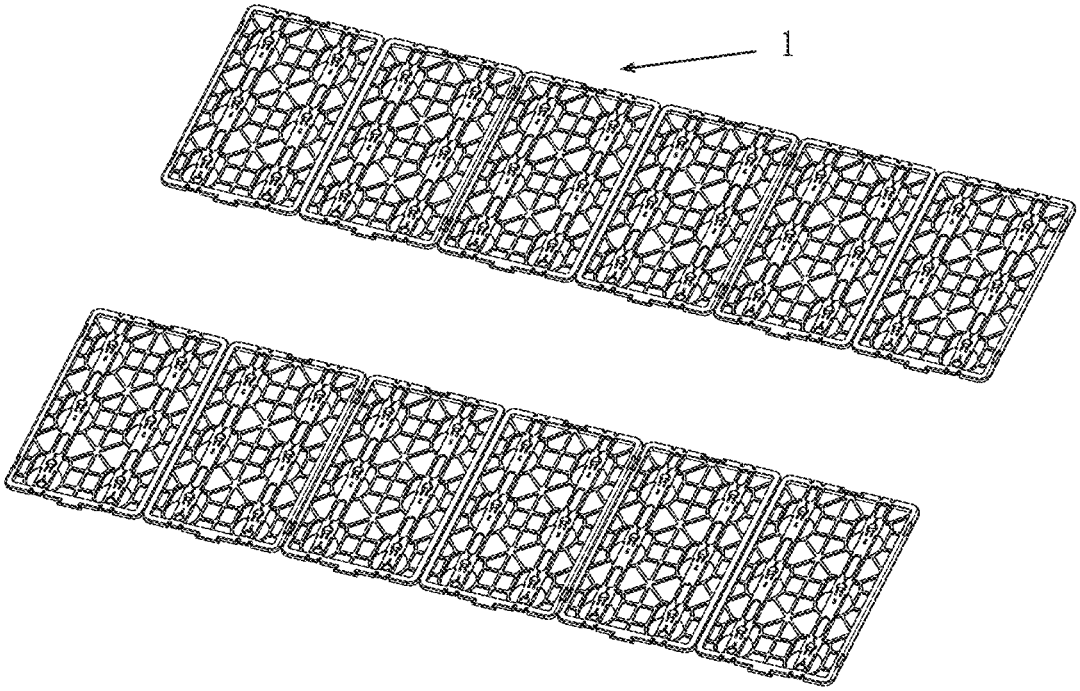
FIG. 2 is a diagrammatic view of splicing of a plurality of mounting frames in Embodiment 1.
Figure 3:
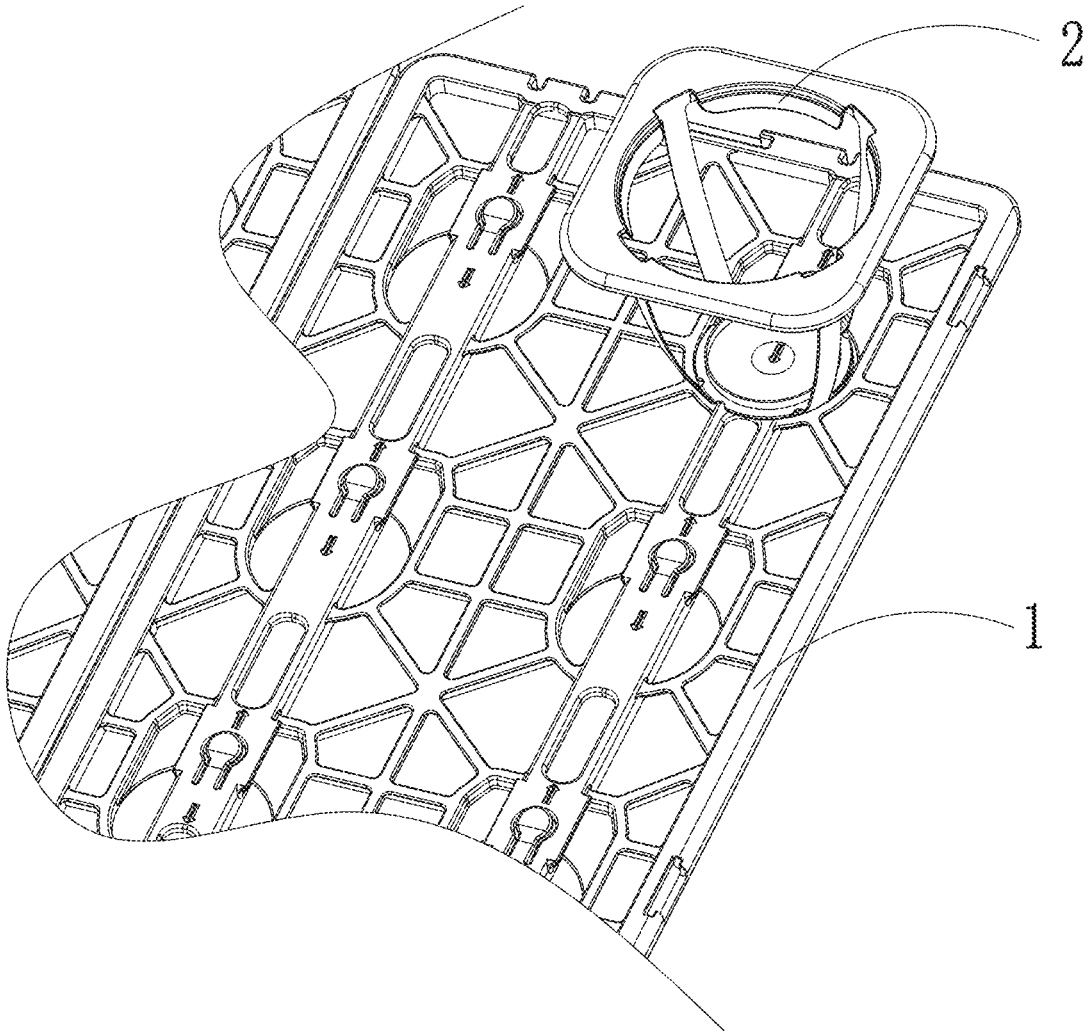
FIG. 3 is a diagrammatic view of an elastic module disposed on a sliding section in Embodiment 1.
Figure 4:
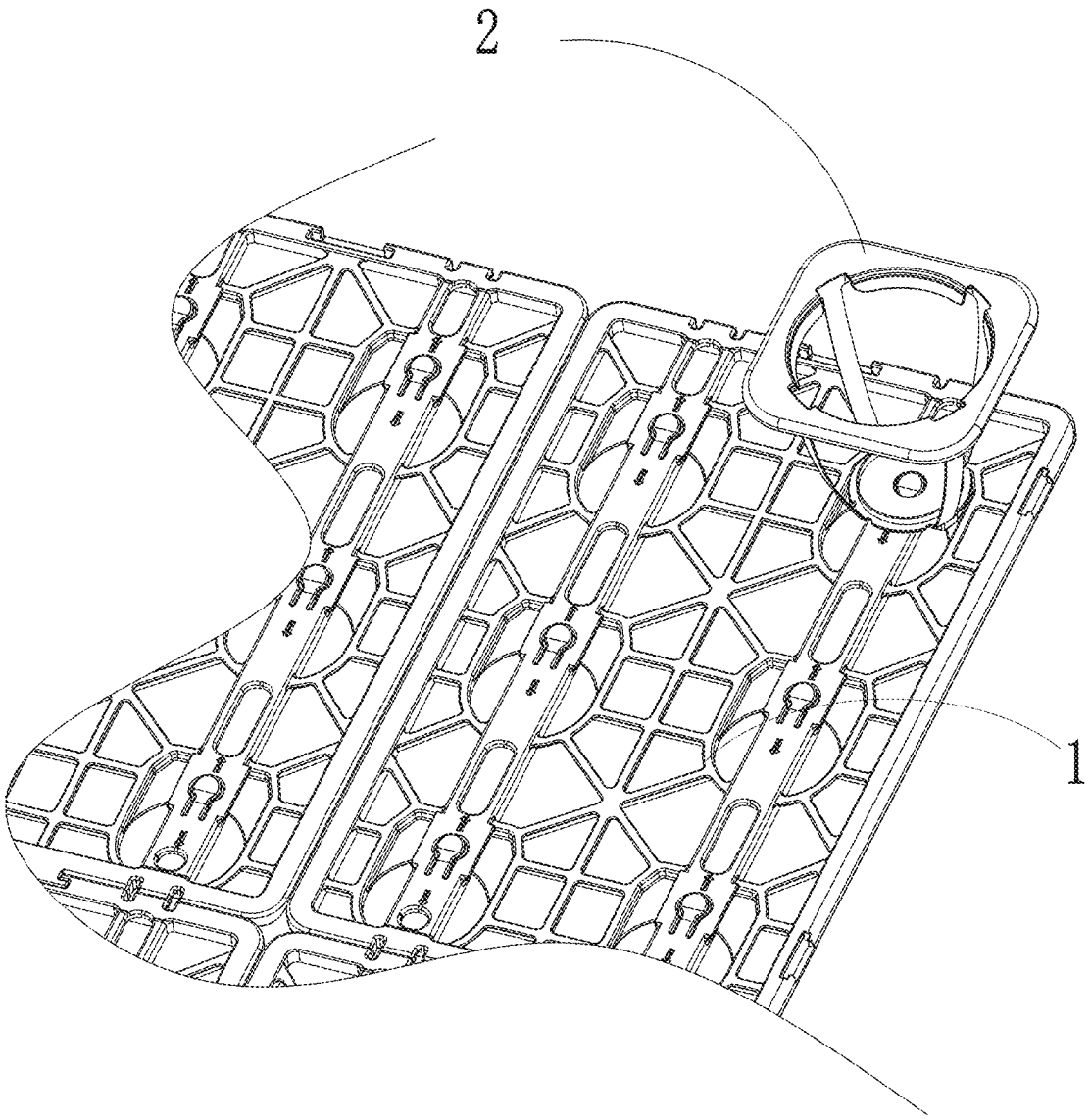
FIG. 4 is a diagrammatic view of the elastic module sliding into a mounting sliding rail in Embodiment 1.
Figure 5:
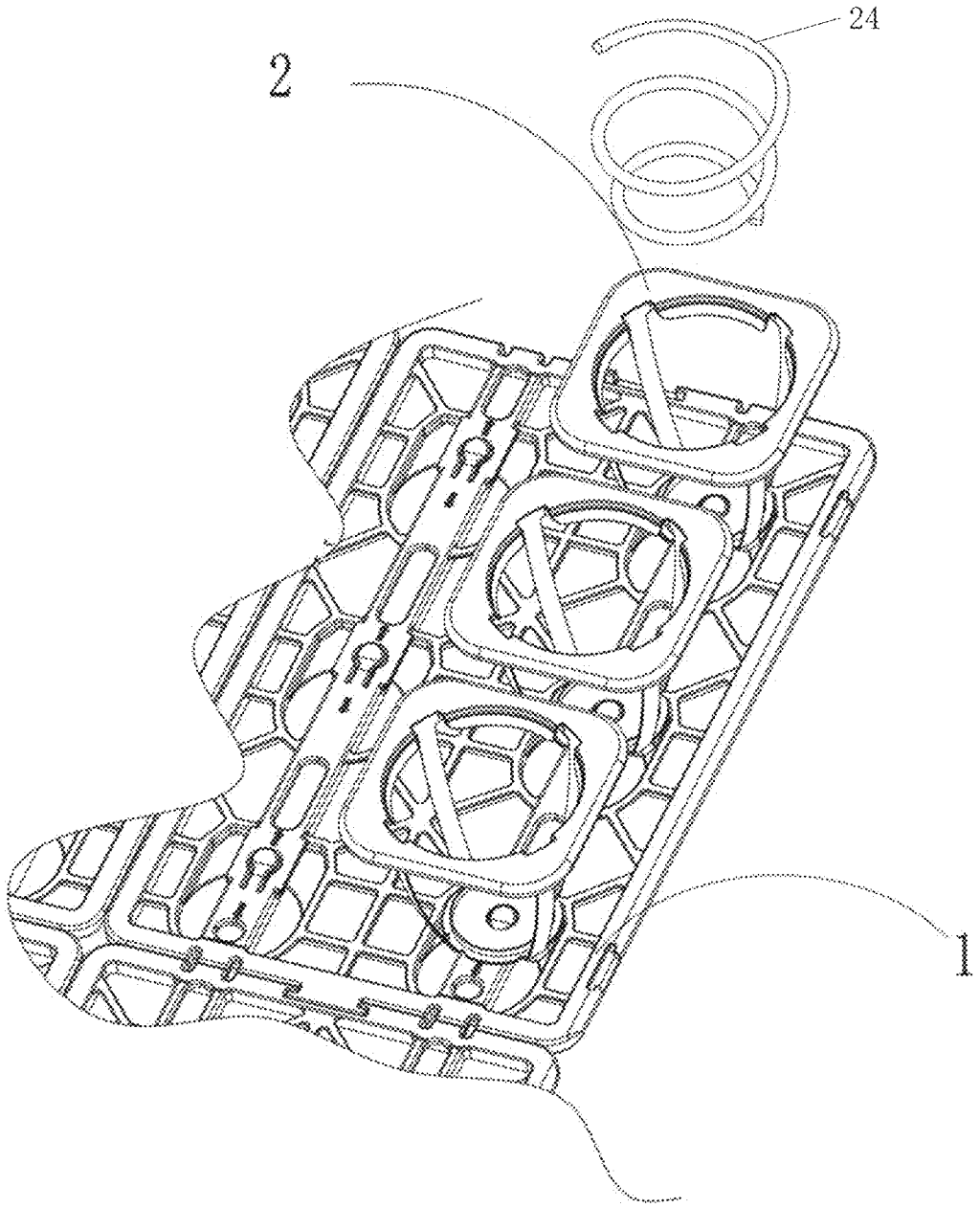
FIG. 5 is a diagrammatic view of three elastic modules sliding into mounting sliding rails in Embodiment 1.
Figure 6:
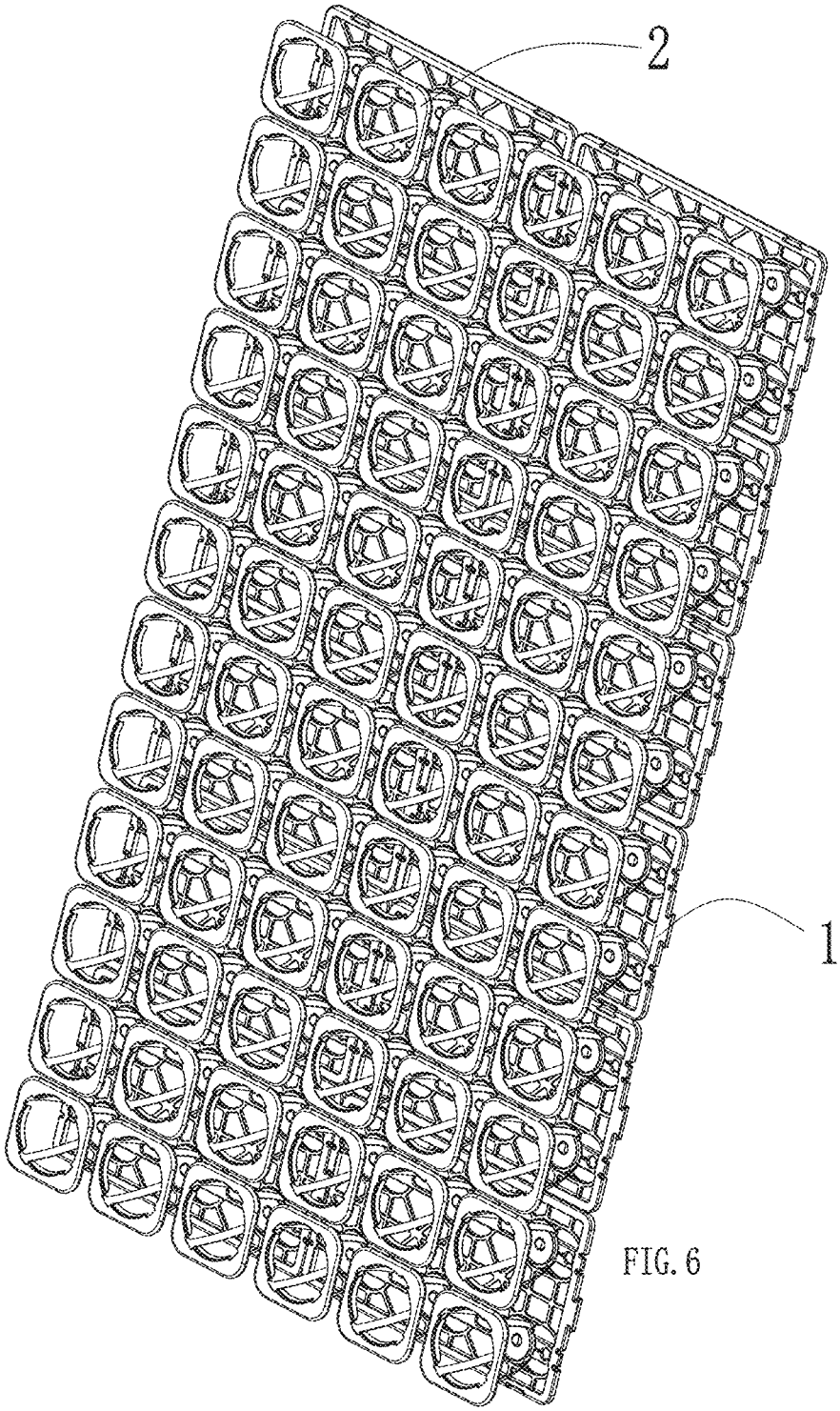
FIG. 6 is a diagrammatic view of a plurality of elastic modules after assembly in Embodiment 1.
Figure 7A:
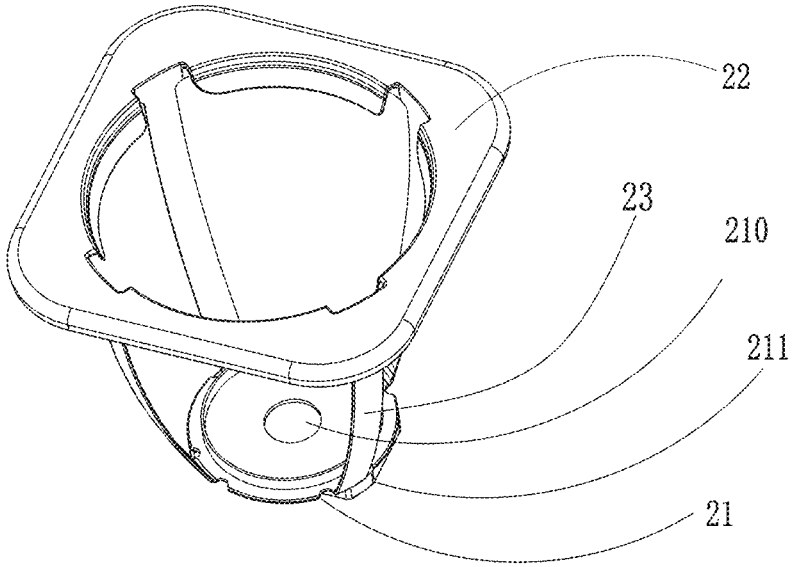
FIG. 7A is a first diagrammatic view of the elastic module in Embodiment 1.
Figure 7B:
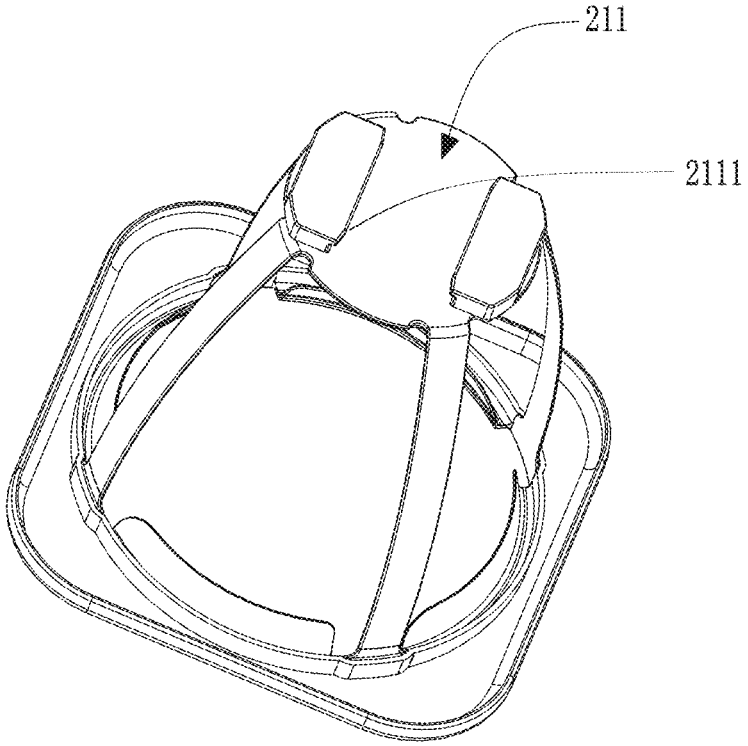
FIG. 7B is a second diagrammatic view of the elastic module in Embodiment 1.
Figure 8:
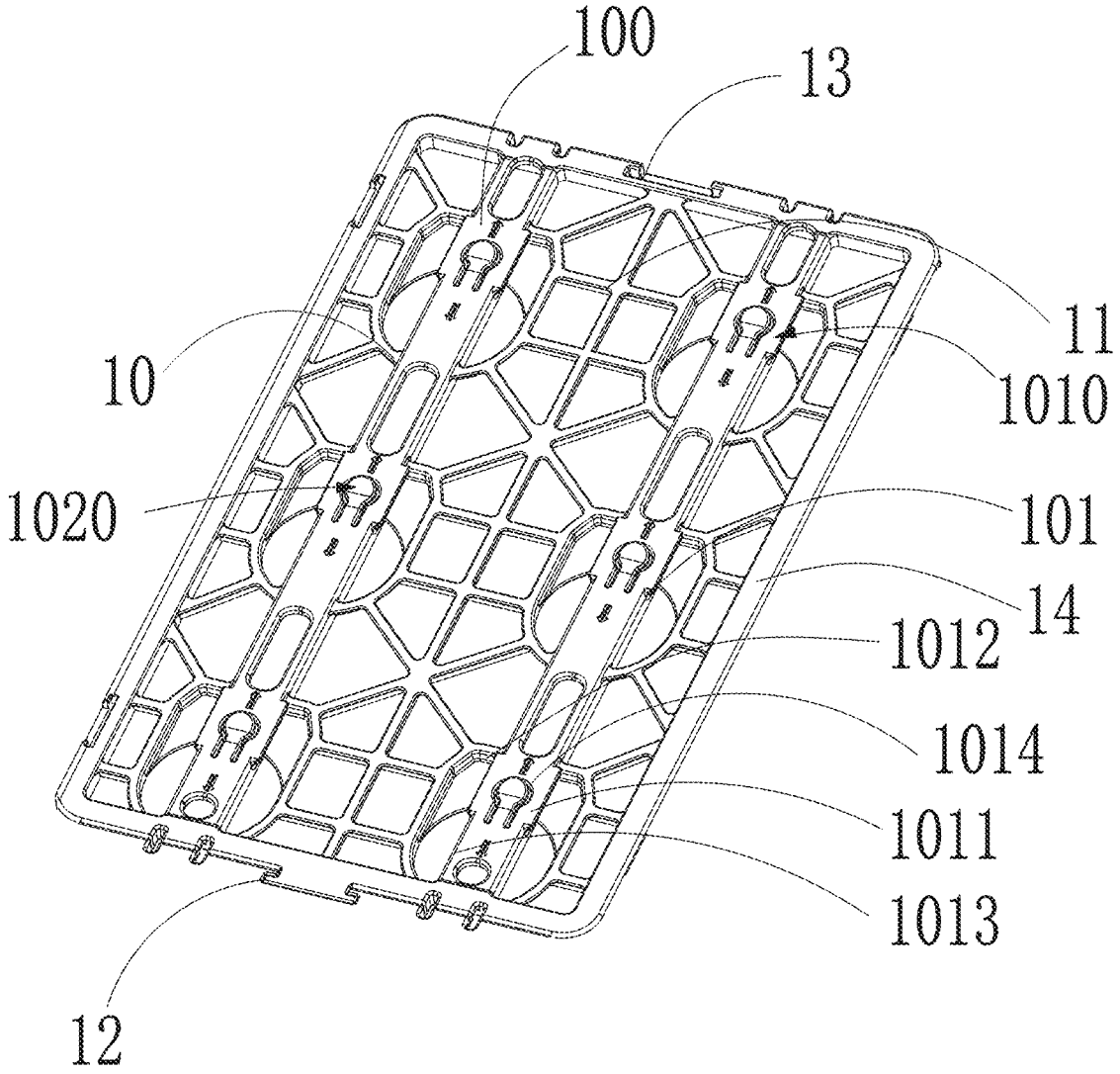
FIG. 8 is a diagrammatic view of a mounting frame in Embodiment 1.
Figure 9:
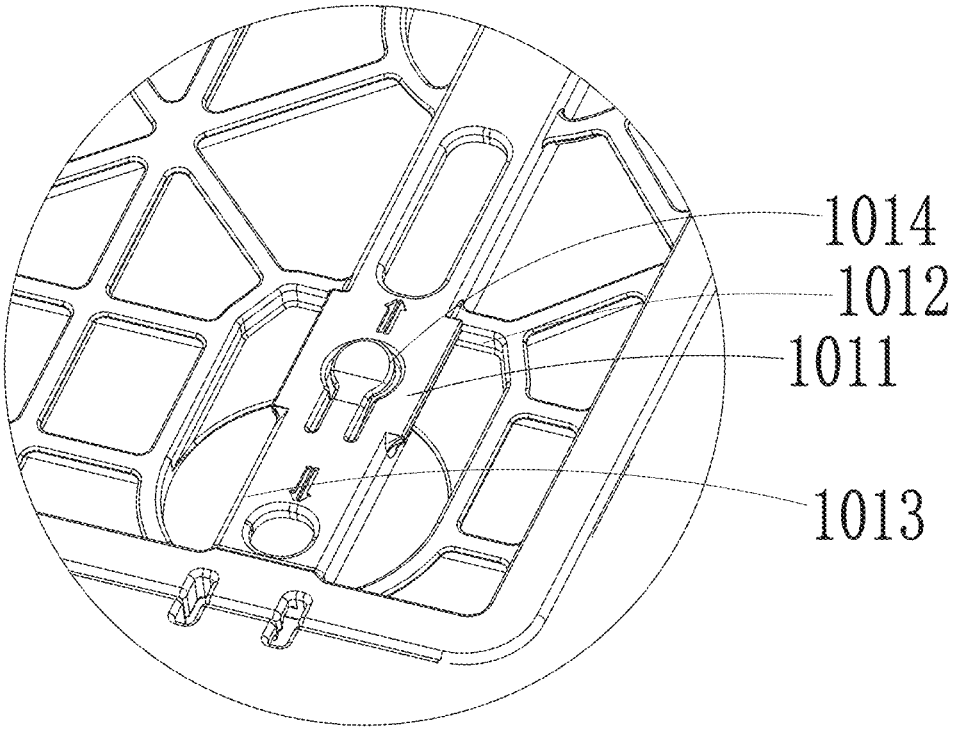
FIG. 9 is a diagrammatic view of a mounting portion in Embodiment 1.
Figure 10:
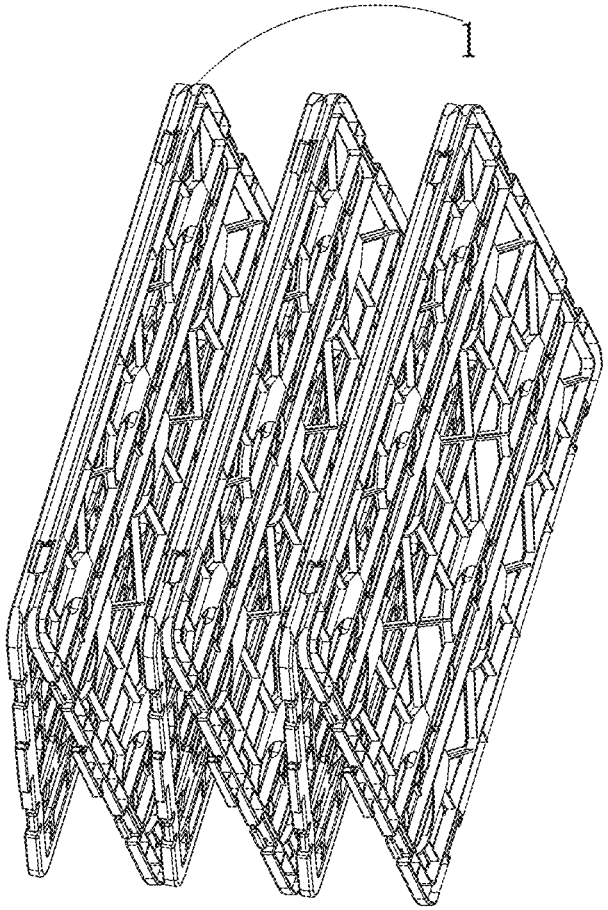
FIG. 10 is a diagrammatic view of a plurality of mounting frames in Embodiment 1 in a folded state.

Referring to FIGS. 1-10, this embodiment provides a spring connecting structure, and the spring connecting structure comprises a mounting rack 30 and one or more elastic modules 2. The mounting rack 30 comprises 12 mounting frames 1, and each of the 12 mounting frames 1 comprises two longitudinal extending portions 10, a connecting portion 11, and side beams 14. The connecting portion 11 is disposed between the two longitudinal extending portions 10 and is disposed between the two longitudinal extending portions 10 and the side beams 14. The one or more elastic modules 2 comprise one or more upper covers 22, one or more bases 21, one or more connecting straps 23, and one or more springs 24 abutting the one or more bases 21 and the one or more upper covers 22. The one or more upper covers 22 are used as one or more supporting surfaces to support a stress applied to the one or more elastic modules 2, and the one or more base 21 are used as one or more connecting ends to be connected to the 12 mounting frames 1. The one or more bases 21 of the one or more elastic modules 2 comprise one or more sliding paths 211. Each of the two longitudinal extending portions 10 comprises three mounting portions 101, and each of the three mounting portions 101 comprises a mounting sliding rail 1010 and a positioning portion 1020 (e.g., an insertion member 1014) to position at a mounting position of a corresponding one of the one or more elastic modules 2. The mounting sliding rail 1010 is positioned at and cooperates with a corresponding one of the one or more sliding paths 211 to enable the corresponding one of the one or more elastic modules 2 to be detachably mounted on the 12 mounting frames 1. Each of the one or more bases 21 is connected to a corresponding one of the one or more upper covers 22 using a corresponding one of the one or more connecting straps 23. The one or more springs 24 can be inverted tapered springs.

Specifically, in this embodiment, each of the two longitudinal extending portions 10 of the 12 mounting frames 1 has a strip 100 extending in a longitudinal direction, and sections of the strip 100 in the three mounting portions 101 respectively have lateral protrusions towards two sides along a width direction to form a T-shaped sliding rail 1011 as the mounting sliding rail 1010. A lower side of each of the one or more bases 21 of the one or more elastic modules 2 comprises a positioning slot 2111 configured to cooperate with the lateral protrusions. The positioning slot 2111 cooperates with and is positioned at the T-shaped sliding rail 1011 formed by the lateral protrusions in a width direction of the positioning slot 2111 and in a vertical direction, so that the one or more elastic modules 2 will not easily detach after installation, and an elastic mattress will be more firm.

In this embodiment, the one or more elastic modules 2 define inverted tapered shapes, so that an area of an upper cover 22 of each of the one or more elastic modules 2 is larger than an area of a base 21 thereof. Therefore, the one or more upper covers 22 of the one or more elastic modules 2 will not affect each other when one of the one or more elastic modules 2 are squeezed after installation of the one or more elastic modules 2. In this embodiment, when a position of the T-shaped sliding rail 1011 on the strip 100 is set, a distance between two adjacent ones of the T-shaped sliding rails 1011 on the mounting rack 30 is greater than a size of a corresponding one of the one or more upper covers 22 of the one or more elastic modules 2. In this way, after the installation of the one or more elastic modules 2 is complete, the one or more elastic modules 2 are vertically mounted on the mounting rack 30 and will not be inclined when one of the one or more elastic modules 2 are squeezed, resulting in stress on the one or more elastic modules 2 being unstable and the elastic mattress being unstable.

In order to allow the positioning slot 2111 of a corresponding one of the one or more bases 21 of the one or more elastic modules 2 to accurately slide into the T-shaped sliding rail 1011, in this embodiment, a first end of the T-shaped sliding rail 1011 comprises a sliding section 1013 configured to cooperate with a corresponding one of the one or more sliding paths 211 in a stay-away way. A width of the sliding section 1013 is smaller than a width of the T-shaped sliding rail 1011, and the positioning slot 2111 can be vertically placed on the sliding section 1013 and then slide horizontally to cooperate with the T-shaped sliding rail 1011.

When a first one of the one or more elastic modules 2 are mounted, the positioning slot 2111 below the first one of the one or more bases 21 of the one or more elastic modules 2 is vertically placed on the sliding section 1013, and the positioning slot 2111 then slides horizontally toward the T-shaped sliding rail 1011 on the strip 100 until the positioning slot 2111 slides to a specified position defined by the positioning portion 1020 to complete the installation. A second one of the one or more elastic modules 2 can be mounted on the T-shaped sliding rail 1011 on the mounting rack 30 in series in a similar way.

In this embodiment, the positioning slot 2111 cooperate with and are positioned at the T-shaped sliding rail 1011 in a width direction of the positioning slot 2111 and in the vertical direction, and the positioning slot 2111 can move in a horizontal sliding direction to enable a corresponding one of the one or more elastic modules 2 to be detachably mounted on the 12 mounting frames 1. When the one or more elastic modules 2 need to be disassembled, the one or more elastic modules 2 slide out in a direction opposite to the horizontal sliding direction by an external force.

In order to further enhance installation stability of the one or more elastic modules 2, in this embodiment, a center of each of the one or more bases 21 of the one or more elastic modules 2 comprises an opening 210, and the T-shaped sliding rail 1011 comprises the insertion member 1014. The insertion member 1014 comprises a fixed end and an elastic end. The fixed end is fixedly connected to the strip 100, and the elastic end has a slope with a height gradually increasing in a direction along which the sliding path 211 slides into the T-shaped sliding rail 1011. A corresponding one of the one or more elastic modules 2 slides into the T-shaped sliding rail 1011, the elastic end of the insertion member 1014 is positioned at and cooperates with the opening 210 of a corresponding one of the one or more bases 21 of the one or more elastic modules 2 at the same time, so that the one or more elastic modules 2 can be further fixedly connected to the 12 mounting frames 1. At this time, the elastic end of the insertion member 1014 is in an initial position.

At the same time, in order to facilitate the one or more elastic modules 2 being disassembled, in this embodiment, the elastic end of the insertion member 1014 can swing from the initial position to a second position under an external force. When the elastic end is in the second position, the elastic end is released from the opening 210. When the one or more elastic modules 2 need to be disassembled, the elastic end is pressed by a hand, so that the elastic end swings from the initial position to the second position to be released from the opening 210 of the corresponding one of the one or more bases 21 of the one or more elastic modules 2.

In this embodiment, the insertion member 1014 is also used as the positioning portion 1020 to determine whether the one or more elastic modules 2 are mounted in place. When a corresponding one of the one or more elastic modules 2 slides to cooperate with and be positioned at the insertion member 1014, the one or more elastic modules 2 are assembled at a predetermined position.

Furthermore, in order to facilitate transportation of the mounting rack 30 and save transportation space, in this embodiment, the 12 mounting frames 1 are foldable in a length direction of the mounting rack 30. A foldable method of the mounting rack 30 is not limited, and the side beams 14 of the 12 mounting frames 1 can be connected using hinges or pivots. First side beams of the side beams 14 of the 12 mounting frames 1 comprise positioning protrusions 12 in a width direction of the 12 mounting frames 1, and second side beams of the side beams 14 opposite to the first side beams comprise positioning grooves 13 corresponding to positions of the positioning protrusions 12. The 12 mounting frames 1 are detachably connected in the width direction of the 12 mounting frames 1.

In this embodiment, every six of the 12 mounting frames 1 are foldably connected together in the length direction of mounting rack 30 to form a foldable spliced body, and the two foldable spliced bodies are connected in the width direction of the mounting rack 30 to form the mounting rack having a rectangular shape.

When the mounting rack 30 is transported or relocated, the mounting rack 30 is first disassembled into the two foldable spliced bodies in the width direction of the mounting rack 30, and then the 12 mounting frames 1 of the two foldable spliced bodies are folded along the length direction of the mounting rack 30 to be stacked together. Therefore, a storage space can be saved to facilitate transportation and relocation.

In this embodiment, in order to enable the one or more elastic modules 2 and the 12 mounting frames 1 to receive uniform stress when the elastic mattress is in use, the connecting portion 11 is a mesh structure having a symmetrical structure.

Embodiment 2

Figure 11:
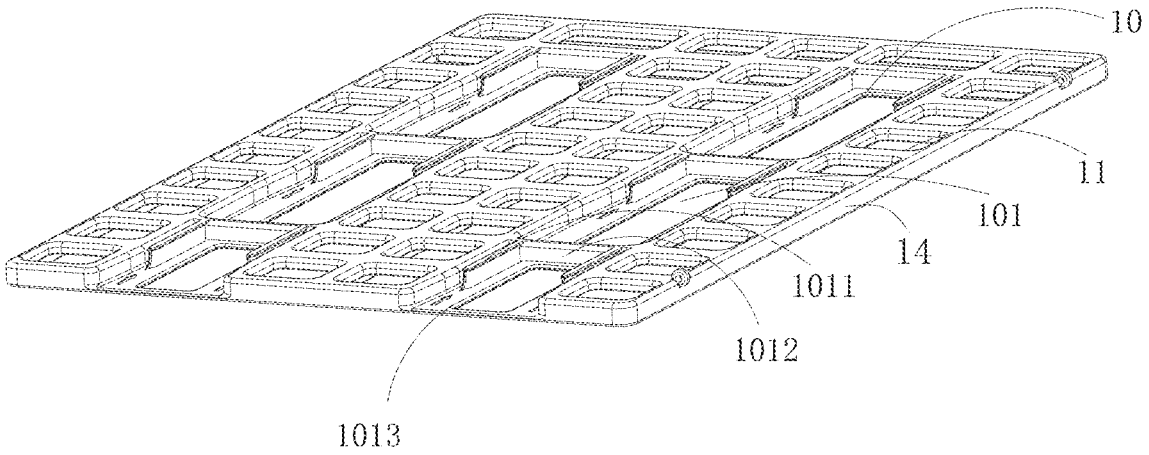
FIG. 11 is a diagrammatic view of one or more mounting frames in Embodiment 2.
Figure 12:
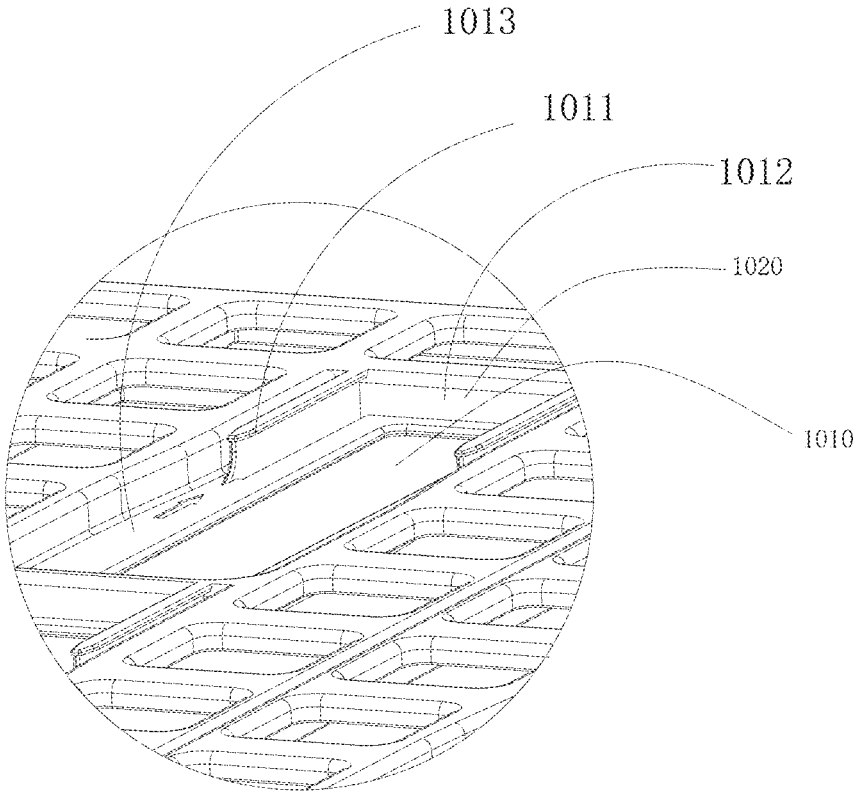
FIG. 12 is a diagrammatic view of a mounting portion in Embodiment 2.
Figure 13:
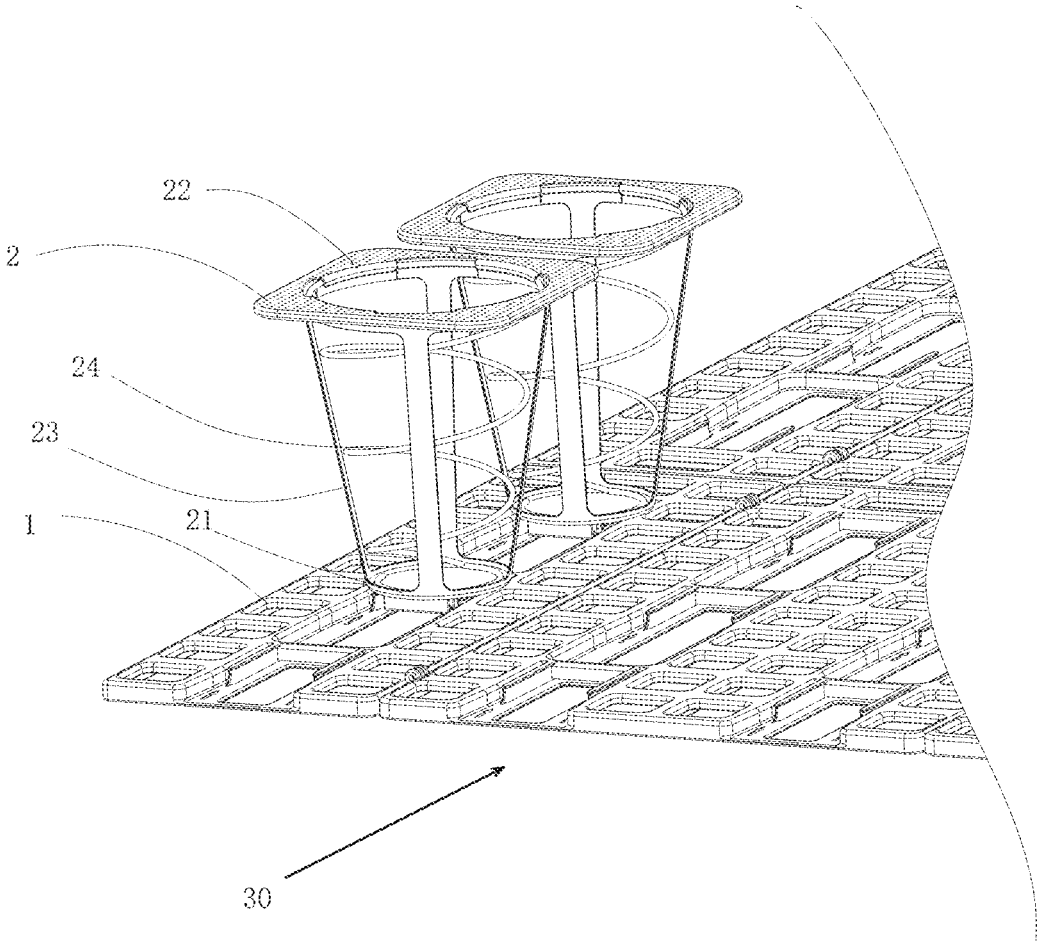
FIG. 13 is a diagrammatic view of the one or more elastic modules sliding into one or more mounting sliding rails in Embodiment 2.
Figure 14:
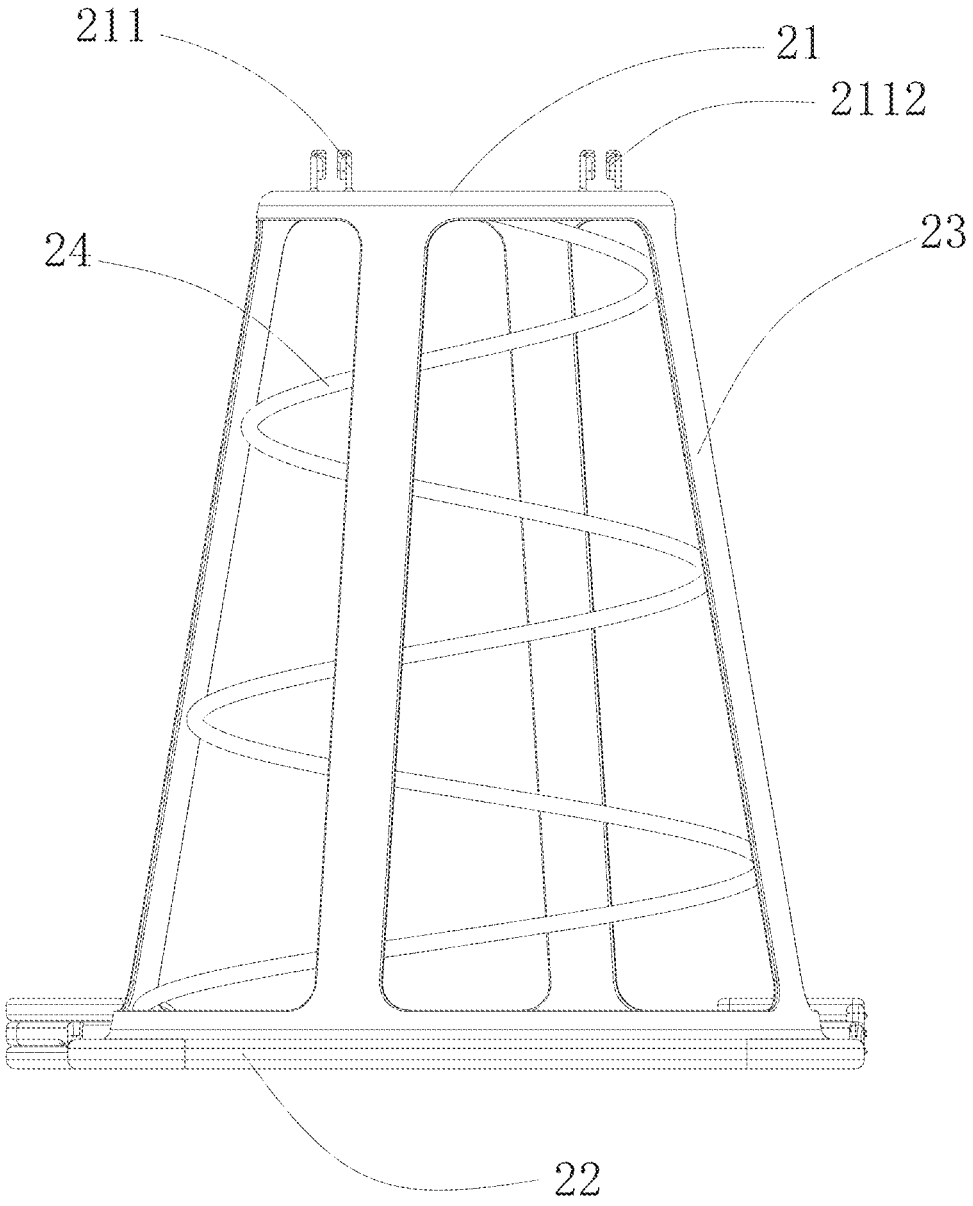
FIG. 14 is a diagrammatic view of the one or more elastic modules in Embodiment 2.

Referring to FIGS. 11-14, this embodiment provides a spring connecting structure, and the spring connecting structure comprises a mounting rack 30 and one or more elastic modules 2. The mounting rack 30 comprises 14 mounting frames 1, and each of the 14 mounting frames 1 comprises two longitudinal extending portions 10, a connecting portion 11, and side beams 14. The connecting portion 11 is disposed between the two longitudinal extending portions 10 and between the two longitudinal extending portions 10 and the side beams 14. The one or more elastic modules 2 comprise one or more upper covers 22, one or more bases 21, one or more connecting straps 23, and one or more springs 24 abutting the one or more bases 21 and the one or more upper covers 22. The one or more upper covers 22 are used as one or more supporting surfaces to support a stress applied to the one or more elastic modules 2, and the one or more bases 21 are used as one or more connecting ends to be connected to the 14 mounting frames 1. Each of the one or more bases 21 of the one or more elastic modules 2 comprise sliding paths 211 parallel to each other. Each of the two longitudinal extending portions 10 comprises three mounting portions 101, and each of the three mounting portions 101 comprises a mounting sliding rail 1010 and a positioning portion 1020 to position at a mount position of a corresponding one of the one or more elastic modules 2. The mounting sliding rail 1010 cooperates with and is positioned at the sliding paths 211 to enable the corresponding one of the one or more elastic modules 2 to be detachably mounted on the 14 mounting frames 1. Each of the one or more bases 21 is connected to a corresponding one of the one or more upper covers 22 using a corresponding one of the one or more connecting straps 23. The one or more springs 24 can be inverted tapered springs.

Specifically, in this embodiment, first ends of the three mounting portions 101 comprise T-shaped sliding rails 1011 formed by vertical protrusions along two sides of the three mounting portions as the mounting sliding rails 1010. A lower side of each of the one or more bases 21 of the one or more elastic modules comprises two strip-shaped slots 2112 configured to cooperate with the vertical protrusions as the sliding paths 211. The two strip-shaped slots 2112 cooperate with and are positioned at two corresponding T-shaped sliding rails of the T-shaped sliding rails 1011 formed by the vertical protrusions in a width direction of the two strip-shaped slots 2112 and a vertical direction, so that the one or more elastic modules 2 will not easily detach after installation, and an elastic mattress will be more firm.

In this embodiment, the one or more elastic modules 2 define inverted tapered shapes, so that an area of an upper cover 22 of each of the one or more elastic modules 2 is larger than an area of a base 21 thereof. Therefore, the one or more upper covers 22 of the one or more elastic modules 2 will not affect each other when one of the one or more elastic modules 2 are squeezed after installation of the one or more elastic modules 2. In this embodiment, when a position of the T-shaped sliding rails 1011 is set, a distance between two adjacent T-shaped sliding rails of the T-shaped sliding rails 1011 on the mounting rack 30 is greater than a size of a corresponding one of the one or more upper covers 22 of the one or more elastic modules 2. After the installation of the one or more elastic modules 2 is complete, the one or more elastic modules 2 are vertically mounted on the mounting rack 30 and will not be inclined when one of the one or more elastic modules 2 are squeezed, resulting in stress on the one or more elastic modules 2 being unstable and the elastic mattress being unstable.

In order to allow the two strip-shaped slots 2112 of each of the one or more bases 21 of the one or more elastic modules 2 to accurately align with the two corresponding T-shaped sliding rails of the T-shaped sliding rails 1011, in this embodiment, first ends of the two corresponding T-shaped sliding rails of the T-shaped sliding rails 1011 comprises a sliding section 1013 configured to cooperate with the two strip-shaped slots 2112 in a stay-away way, and the sliding section 1013 comprises a groove with a width greater than a distance between the two corresponding T-shaped sliding rails 1011. The two strip-shaped slots 2112 can be vertically placed on the groove in the sliding section 1013 and then slide horizontally into the two corresponding T-shaped sliding rails 1011.

In order to enable the two strip-shaped slots 2112 to slide to cooperate with the two corresponding T-shaped sliding rails 1011 more smoothly, in this embodiment, the two corresponding T-shaped sliding rails 1011 comprise sharp ends adjacent to the groove in the sliding section 1013 to facilitate the two strip-shaped slots 2112 of the one or more elastic modules 2 sliding into the two corresponding T-shaped sliding rails 1011.

When a first one of the one or more elastic modules 2 is mounted, the two strip-shaped slots 2112 below the first of the one or more bases 21 of the one or more elastic modules 2 are vertically placed in the groove in the sliding section 1013 and are then slide horizontally toward the two corresponding T-shaped sliding rails 1011 protruding in a vertical direction until the first one of the one or more elastic modules 2 abuts a groove wall 1012 of the groove. The first one of the one or more elastic modules 2 are then mounted in place. At this time, the positioning portion 1020 is the groove wall 1012 of an end of the groove in a sliding-in direction of the mounting sliding rails 1010. A second one of the one or more elastic modules 2 can be mounted on two corresponding T-shaped sliding rails of the T-shaped sliding rails 1011 of the mounting rack 30 in sequence in a similar way.

In this embodiment, the two strip-shaped slots 2112 cooperate with and are positioned at the two corresponding T-shaped sliding rails of the T-shaped sliding rails 1011 in a width direction of the two strip-shaped slots 2112 and in a vertical direction. The two strip-shaped slots 2112 can move in a horizontal sliding direction to enable a corresponding one of the one or more elastic modules 2 to be detachably mounted on the 14 mounting frames 1. When the one or more elastic modules 2 need to be disassembled, the one or more elastic modules 2 slide out in a direction opposite to the horizontal sliding direction by an external force.

In this embodiment, every seven of the 14 mounting frames 1 are connected together in the length direction of mounting rack 30 to form a spliced body, and the two spliced bodies are connected in the width direction of the mounting rack 30 to form the mounting rack 30 having a rectangular shape.

When the mounting rack is transported or relocated, the mounting rack 30 is first disassembled into the two spliced bodies in the width direction of the mounting rack 30. Therefore, a storage space can be saved to facilitate transportation and relocation of the mounting rack 30. The rest is the same as those features described in Embodiment 1 and will not be described again herein.

Embodiment 3

Figure 15:
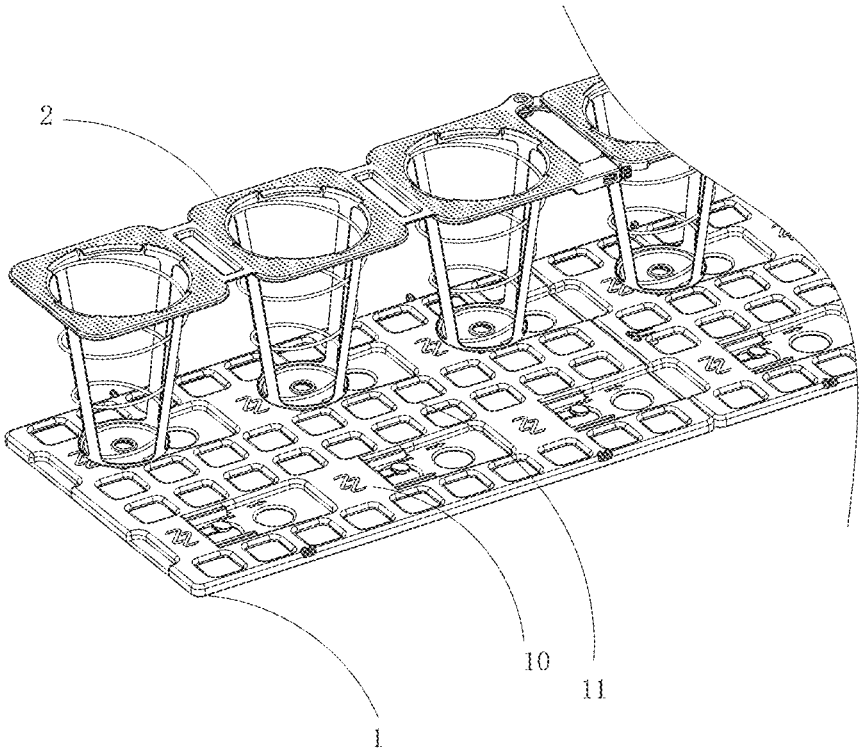
FIG. 15 is a diagrammatic view of one or more mounting frames in Embodiment 3.
Figure 16:
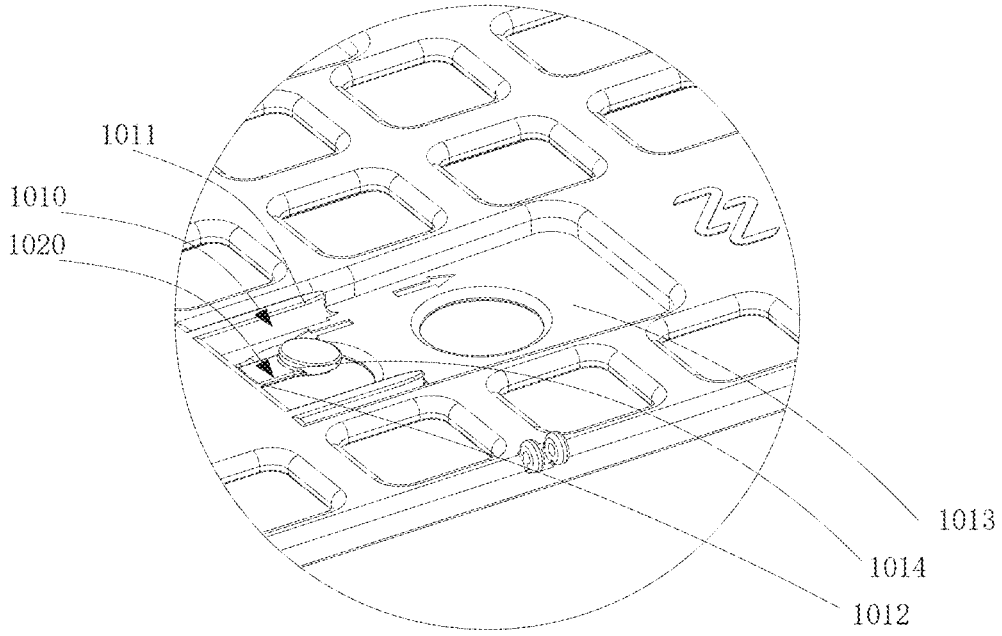
FIG. 16 is a diagrammatic view of a mounting portion in Embodiment 3.
Figure 17:
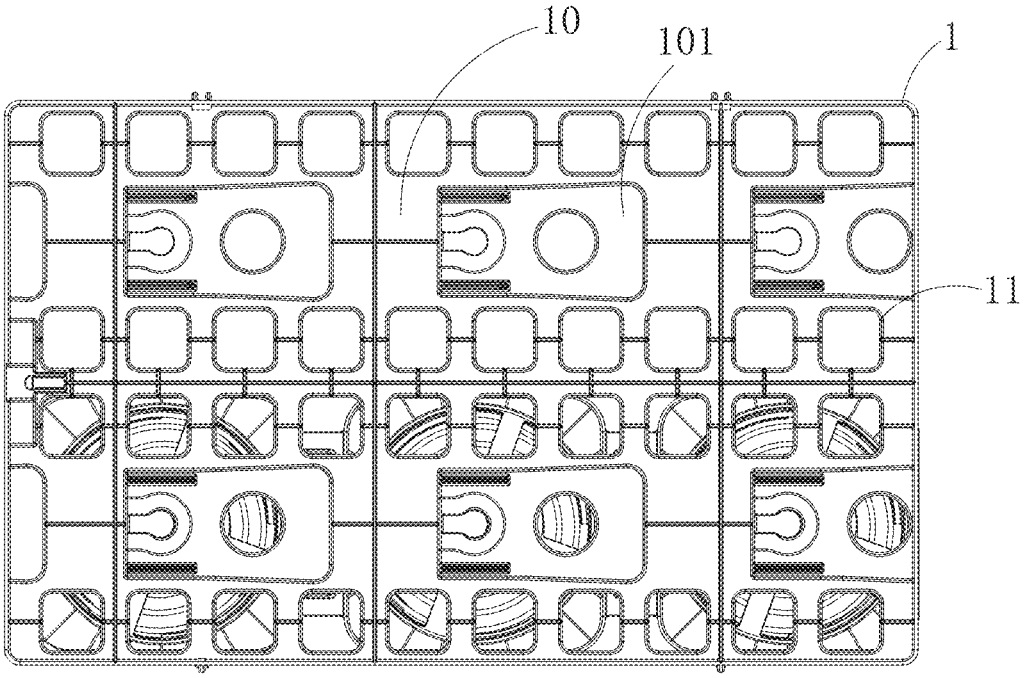
FIG. 17 is a top view of the one or more mounting frames in Embodiment 3.
Figure 18:
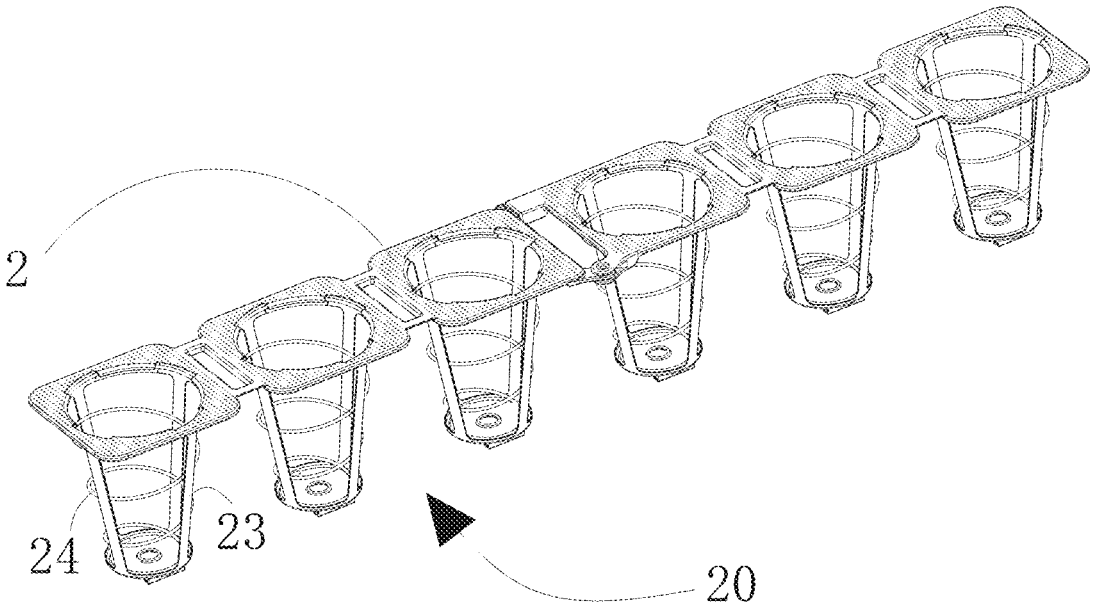
FIG. 18 is a diagrammatic view of rows of springs in Embodiment 3.
Figure 19:
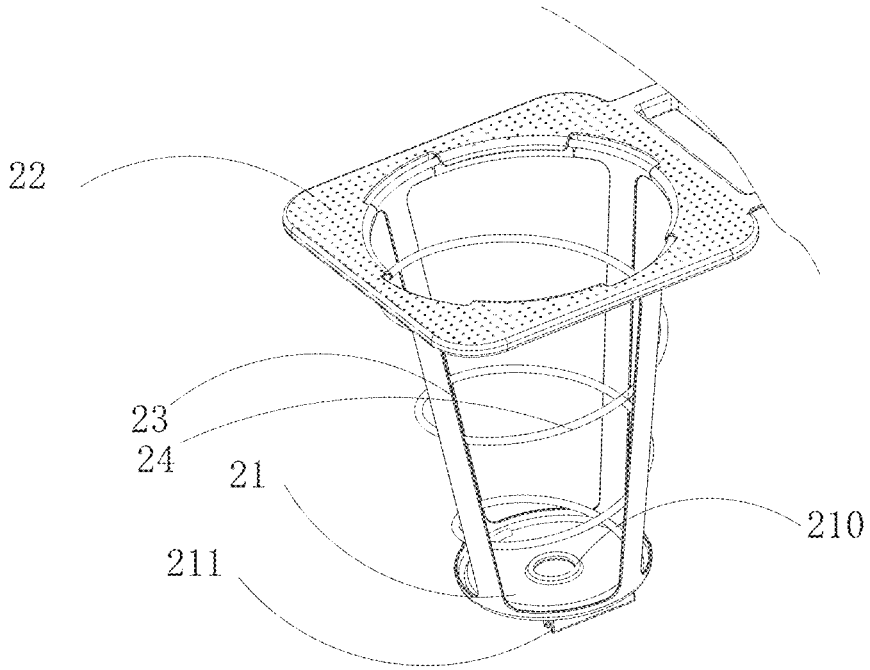
FIG. 19 is a diagrammatic view of one or more elastic modules in Embodiment 3.
Figure 20:
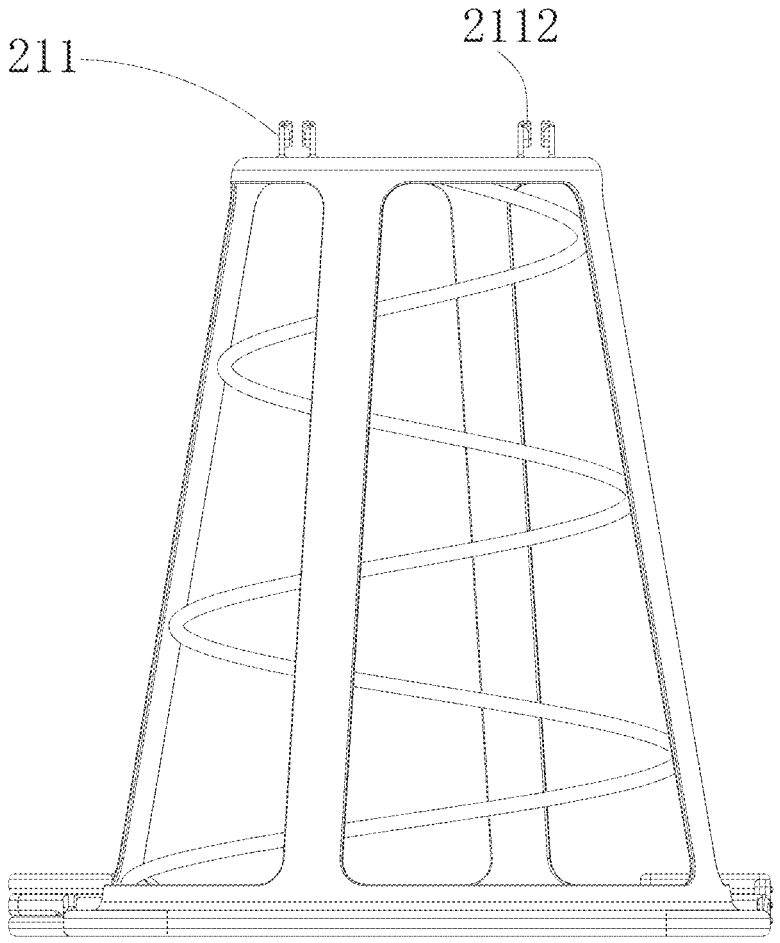
FIG. 20 is a diagrammatic view of one or more sliding paths on a bottom of the one or more elastic modules having inverted tapered shapes in Embodiment 3.
Figure 21:
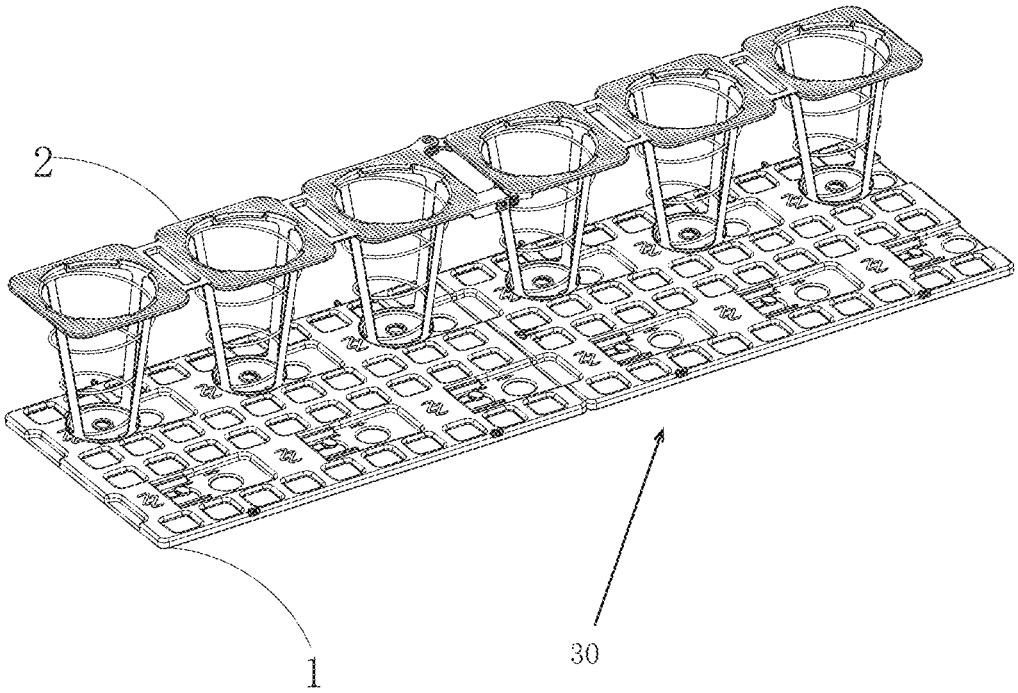
FIG. 21 is a diagrammatic view of the one or more elastic modules sliding into one or more mounting sliding rails in Embodiment 3.
Figure 22:
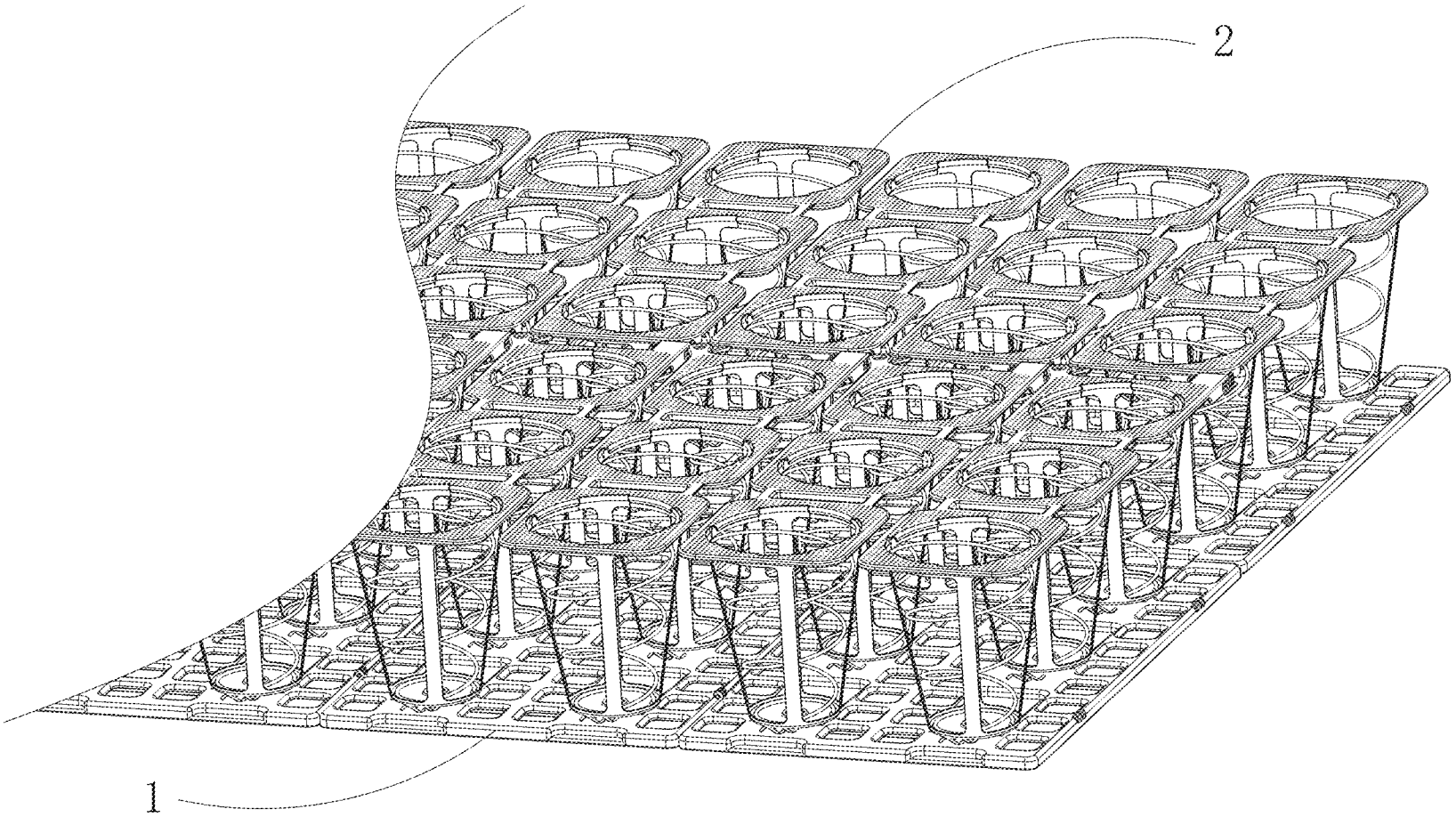
FIG. 22 is a diagrammatic view of the one or more elastic modules after installation in Embodiment 3.

Referring to FIGS. 15-22, this embodiment provides a spring connecting structure, and the spring connecting structure comprises a mounting rack 30 and one or more elastic modules 2. The mounting rack 30 comprises 12 mounting frames 1, and each of the 12 mounting frames 1 comprises two longitudinal extending portions 10, a connecting portion 11, and side beams 14. The connecting portion 11 is disposed between the two longitudinal extending portions 10 and between the two longitudinal extending portion 10 and the side beams 14. Each of the two longitudinal extending portions 10 comprises three mounting portions 101, and each of the three mounting portions 101 comprises a mounting sliding rail 1010 and a positioning portion 1020 to position at a mount position of a corresponding one of the one or more elastic modules 2.

In order to further enhance stability and durability of the elastic mattress during use, in this embodiment, upper covers 22 of three elastic modules 2 disposed on the three mounting portions 101 are connected together to form a row of springs 20. The one or more elastic modules 2 comprise the one or more bases 21, the one or more upper covers 22, one or more connecting straps 23, and one or more springs 24 abutting the one or more bases 21 and the one or more upper covers 22. The one or more elastic modules 2 define inverted tapered shapes, so that an area of each of the one or more upper covers 22 is larger than an area of a corresponding one of the one or more bases 21, and a connection between the upper covers 22 of the three elastic modules 2 is a flexible connection. An upper cover 22 of a first one of the three elastic modules 2 is connected to an upper cover 22 of a second one of the three elastic modules 2 adjacent to the upper cover 22 of the first one to form the row of springs 20 to be more stable and have better load-bearing capacity relative to applied stress. Stability and durability of the elastic mattress can be improved during use, a service life of the elastic mattress is increased, and the load-bearing capacity of the elastic mattress is improved. Each of the one or more bases 21 is connected to a corresponding one of the one or more upper covers 22 using a corresponding one of the one or more connecting straps 23. The one or more springs 24 can be inverted tapered springs. The one or more bases 21 of the one or more elastic modules 2 comprise strip-shaped slots 2112 parallel to each other as sliding paths 211.

In order to form a row of structures using the rows of springs 20 on different mounting frames 1 of the 12 mounting frames 1, in this embodiment, the rows of springs 20 on the different mounting frames 1 are detachably connected in a width direction of the mounting rack 30. After installation is complete, two rows of the rows of springs 20 are connected together in the width direction of the mounting rack 30 to enable the rows of springs 20 to form an integrated structure. The stability and the load-bearing capacity relative to the applied stress is further improved compared with a single row of springs 20. When disassembly is required, merely a connection between the rows of springs 20 needs to be disassembled.

In this embodiment, in order to cooperate with the row of springs 20, each of the two longitudinal extending portions 10 of the 12 mounting frames 1 comprises three mounting portions 101 for receiving the three elastic modules 2 having inverted tapered shapes. First ends of the three mounting portions 101 have vertical protrusions along two sides of the three mounting portions 101 to form T-shaped sliding rails 1011 as the mounting sliding rails 1010. A lower side of each of the one or more bases 21 of the one or more elastic modules 2 of the row of springs 20 comprises two strip-shaped slots 2112 configured to cooperate with the vertical protrusions as the sliding paths 211. The two strip-shaped slots 2112 cooperate with and are positioned at two corresponding T-shaped sliding rails of the T-shaped sliding rails 1011 formed by the vertical protrusions in a width direction of the two strip-shaped slots 2112 and a vertical direction, so that the one or more elastic modules 2 will not easily detach after installation and the elastic mattress will be more firm.

At the same time, as each of the three elastic modules 2 of the row of springs 20 has an inverted tapered shape, a width of an upper cover 22 of each of the three elastic modules of the row of springs 20 is greater than a width of a base 21 thereof to ensure upper covers 22 of the three elastic modules 2 of the row of springs 20 after installation will be not inclined when one of the three elastic modules 2 are squeezed. In this embodiment, when a position of the T-shaped sliding rails 1011 is set, a distance between two adjacent T-shaped sliding rails 1011 of the T-shaped sliding rails 1011 of the mounting rack 30 is greater than a size of the upper cover 22 of a corresponding one of the three elastic modules 2. After installation of the elastic module 2 is complete, the row of springs 20 is vertically mounted on the mounting rack 30 and will be not inclined when the one of the three elastic modules 2 having the inverted tapered shapes are squeezed. At the same time, the rows of springs 20 on the different mounting frames 1 will not be squeezed against each other to cause the one or more elastic modules 2 to be unstable, resulting in the elastic mattress being unstable.

In order to allow the two strip-shaped slots 2112 of each of the one or more bases 21 of the one or more elastic modules 2 to accurately align with two corresponding T-shaped sliding rails of the T-shaped sliding rails 1011, in this embodiment, first ends of the two T-shaped sliding rails 1011 comprises a sliding section 1013 configured to cooperate with the two strip-shaped slots 2112. The sliding section 1013 comprises a groove with a width greater than a distance between two corresponding T-shaped sliding rails 1011. The two strip-shaped slots 2112 are vertically placed in the groove and then slide horizontally into the two corresponding T-shaped sliding rails 1011.

In order to allow the two strip-shaped slots 2112 to slide into the two corresponding T-shaped sliding rails 1011 more smoothly, in this embodiment, the first ends of the two corresponding T-shaped sliding rails 1011 adjacent to the sliding section 1013 comprise sharp ends to facilitate the two strip-shaped slots 2112 of the one or more elastic modules 2 sliding into the two corresponding T-shaped sliding rails 1011.

When the row of springs 20 are assembled, the two strip-shaped slots 2112 of the base 21 of each of the three elastic modules 2 of the row of springs 20 are vertically placed in a corresponding one of the grooves and then slide horizontally toward the two corresponding T-shaped sliding rails 1011 protruding vertically, until the three elastic modules 2 abut groove walls 1012 of the grooves such that the three elastic modules 2 are mounted in place. At this time, the positioning portion 1020 is the groove walls 1012 on first ends of the grooves in a sliding-in direction of the T-shaped sliding rails 1011. Each of the rows of springs 20 can be mounted on the two corresponding T-shaped sliding rails 1011 on the mounting rack 30 in series in a similar way.

In this embodiment, the two strip-shaped slots 2112 cooperate with and are positioned at the two corresponding T-shaped sliding rails 1011 in the width direction of the two strip-shaped slots 2112 and in the vertical direction and can horizontally move in a sliding direction, so that the one or more elastic modules 2 can be detachably mounted on the 12 mounting frames 1. When the one or more elastic modules 2 need to disassembled, the one or more elastic modules 2 slide out in a direction opposite to the sliding direction using an external force.

In order to further enhance firmness of the installation of the one or more elastic modules 2, in this embodiment, a center of the base 21 of each of the one or more elastic modules 2 having inverted tapered shapes of the row of springs 20 comprises an opening 210, and an insertion member 1014 is disposed between the two corresponding T-shaped sliding rails 1011. The insertion member 1014 comprises a fixed end and an elastic end. The fixed end is fixedly connected to the groove wall 1012 on the two longitudinal extending portions 10, and the elastic end of the insertion member 1014 cooperates with and is positioned at the opening 210 of the base 21 of a corresponding one of the one or more elastic modules 2 having the inverted tapered shapes. While each of the one or more elastic modules 2 having the inverted tapered shapes horizontally slide toward the two corresponding T-shaped sliding rails 1011, the elastic end passes through the opening 210 of the base 21 of the corresponding one of the one or more elastic modules 2 to cooperate with and be positioned at the opening 210. At this time, the elastic end of the insertion member 1014 is in an initial position, and the firmness of the installation of the one or more elastic modules 2 can be further enhanced.

At the same time, in order to facilitate the one or more elastic modules 2 being disassembled, in this embodiment, the elastic end of the insertion member 1014 can swing from the initial position to a second position under an external force. When the elastic end is in the second position, the elastic end is released from the opening 210. When the one or more elastic modules 2 having the inverted tapered shapes need to be disassembled, the elastic end is pressed by a hand, so that the elastic end swings from the initial position to the second position to be released from the opening 210 of the base 21 of the corresponding one of the one or more elastic modules 2 having the inverted tapered shapes.

In this embodiment, the insertion member 1014 and the groove wall 1012 are used as the positioning portion 1020 to determine whether the one or more elastic modules 2 are mounted in place. When a corresponding one of the one or more elastic modules 2 slides to cooperate with and be positioned at the insertion member 1014, the one or more elastic modules 2 are assembled at a predetermined position.

Furthermore, in order to facilitate transportation of the mounting rack 30 and save transportation space, in this embodiment, the 12 mounting frames 1 are foldable in a length direction of the mounting rack 30.

In this embodiment, every six of the 12 mounting frames 1 are connected together in the length direction of mounting rack 30 to form a spliced body, and the two spliced bodies are connected in the width direction of the mounting rack 30 to form the mounting rack 30 having a rectangular shape.

When the mounting rack 30 is transported or relocated, the mounting rack 30 is first disassembled into the two spliced bodies in the width direction of the mounting rack 30, and a storage space can be therefore saved to facilitate transportation and relocation. The rest is the same as those features described in Embodiment 1 and will not be described again herein.

A number of the mounting frames 1 of the mounting rack 30, a number of the longitudinal extending portions 10 on the mounting frame 1, and a number of the mounting portions 101 on the longitudinal extending portions 10 can be adjusted as needed and are not limited to Embodiment 1, Embodiment 2, and Embodiment 3.

The aforementioned embodiments are merely some embodiments of the present disclosure, and the design and the concept of the disclosure is not limited thereto. Thus, it is intended that the present disclosure cover non-substantive modifications of the present disclosure provided they are made based on the concept within the technical scope disclosed in the present disclosure by any technical person skilled in the art.

What is claimed is:

1. An elastic connection structure, comprising:

a mounting rack, and a plurality of elastic modules, wherein:

the mounting rack comprises one or more mounting frames, the one or more mounting frames comprise a plurality of longitudinal extending portions and one or more connecting portions, the one or more connecting portions are disposed between the plurality of longitudinal extending portions and disposed between the plurality of longitudinal extending portions and one or more side beams of the one or more mounting frames, each of the plurality of elastic modules comprises an upper cover and a base, the upper covers is used as a supporting surface, the bases is used as a connecting end to be connected to a corresponding one of the one or more mounting frames, the bases comprises a sliding path, the plurality of longitudinal extending portions comprise a plurality of mounting portions, each of the plurality of mounting portions comprises a mounting sliding rail and a positioning portion to enable a corresponding one of the plurality of elastic modules to be positioned at a mount position, a distance between two adjacent mounting sliding rails of two adjacent mounting portions of the plurality of mounting portions on the mounting rack is greater than a size of the upper cover of the a corresponding one of the plurality of elastic modules, the sliding path cooperates with and is positioned at the mounting sliding rail of a corresponding one of the plurality of mounting portions to enable the corresponding one of the plurality of elastic modules to be detachably mounted on the corresponding one of the one or more mounting frames, the plurality of elastic modules define a row of springs in which the upper covers in the plurality of elastic modules are connected together, and a number of the plurality of elastic modules in the row of springs is the same as a number of the plurality of mounting portions on the one or more mounting frames.

2. The elastic connection structure according to claim 1, wherein a corresponding one of one or more sliding sections configured to cooperate with the sliding paths is disposed on a first end of the mounting sliding rail of the corresponding one of the plurality of mounting portions to enable the sliding path to be placed on the corresponding one of the one or more sliding sections in a vertical direction and then slide horizontally into the mounting sliding rail of the corresponding one of the plurality of mounting portions.

3. The elastic connection structure according to claim 2, wherein the plurality of longitudinal extending portions are strips extending longitudinally.

4. The elastic connection structure according to claim 3, wherein each of the mounting sliding rails is a T-shaped sliding rail formed by lateral protrusions on two sides of a corresponding one of the strips along a width direction.

5. The elastic connection structure according to claim 4, wherein:

the sliding path comprises a positioning slot configured to cooperate with the lateral protrusions, and the positioning slot is positioned at and cooperates with the lateral protrusions in the vertical direction and a width direction of the positioning slot.

6. The elastic connection structure according to claim 4, wherein a width of a corresponding one of the one or more sliding sections is smaller than a width of the T-shaped sliding rail.

7. The elastic connection structure according to claim 2, wherein each of the mounting sliding rails is a T-shaped sliding rail formed by vertical protrusions on two sides of a corresponding one of the plurality of mounting portions.

8. The elastic connection structure according to claim 7, wherein the sliding path comprises two strip-shaped slots configured to cooperate with two corresponding vertical protrusions of the vertical protrusions.

9. The elastic connection structure according to claim 7, wherein the T-shaped sliding rails comprises sharp ends adjacent to a corresponding one of the one or more sliding sections to facilitate the sliding paths sliding into the T-shaped sliding rails.

10. The elastic connection structure according to claim 7, wherein each of the one or more sliding sections comprises a groove with a width greater than a distance between the T-shaped sliding rails in the corresponding one of the plurality of mounting portions.

11. The elastic connection structure according to claim 10, wherein the positioning portion is a groove wall of an end of the groove in a sliding-in direction of a corresponding one of the mounting sliding rails.

12. The elastic connection structure according to claim 11, wherein a center of the bases comprises an opening.

13. The elastic connection structure according to claim 12, wherein:

an insertion member is disposed between the T-shaped sliding rails in the corresponding one of the plurality of mounting portions, the insertion member comprises a fixed end and an elastic end, the fixed end is fixedly connected to a corresponding one of the plurality of longitudinal extending portions, the elastic end is configured to swing from an initial position to a second position due to an external force, when the elastic end is in the initial position, the elastic end is connected to the opening of a the corresponding one of the plurality of elastic modules, and when the elastic end is in the second position, the elastic end is separated from the opening of the corresponding one of the plurality of elastic modules.

14. The elastic connection structure according to claim 13, wherein the elastic end has a slope with a height gradually increasing along a direction in which the sliding path of the corresponding one of the plurality of elastic modules slide the mounting sliding rail of the corresponding one of the one or more mounting frames.

15. The elastic connection structure according to claim 1, wherein:

the plurality of elastic modules define inverted tapered shapes, and an area of the upper cover of each of the plurality of elastic modules is larger than an area of the bases.

16. The elastic connection structure according to claim 1, wherein a connection between the upper cover of each of the plurality of elastic modules is a flexible connection.

17. The elastic connection structure according to claim 1, wherein:

the one or more mounting frames comprise a plurality of mounting frames, and the row of springs on a first mounting frame of the plurality of mounting frames is detachably connected to the row of springs on a second mounting frame of the plurality of mounting frames.

18. The elastic connection structure according to claim 1, wherein:

the one or more mounting frames comprise a plurality of mounting frames, a first side beam of the one or more side beams on a first mounting frame of the plurality of mounting frames comprises at least one of a first positioning protrusion or a first positioning groove, a second side beam of the one or more side beams on a second mounting frame of the plurality of mounting frames comprises at least one of a second positioning protrusion or a second positioning groove, and the at least one of the first positioning protrusion or the first positioning groove on the first side beam and the at least one of the second positioning protrusion or the second positioning groove on the second side beam cooperate with each other to enable the plurality of mounting frames to be detachably connected to each other.

19. The elastic connection structure according to claim 18, wherein:

the plurality of mounting frames are connected together in a length direction of the mounting rack to form a plurality of spliced bodies, and the plurality of spliced bodies are connected in a width direction of the mounting rack to form a rectangular mounting rack.

20. An elastic mattress, wherein the elastic mattress comprises the elastic connection structure according to claim 1.

21. A method for using the elastic mattress, comprising:

using the elastic mattress according to claim 20 in a sofa, a bed mattress, or a soft package.

22. An elastic connection structure, comprising:

a mounting rack, and one or more elastic modules, wherein:

the mounting rack comprises a plurality of mounting frames, the plurality of mounting frames comprise a plurality of longitudinal extending portions and one or more connecting portions, the one or more connecting portions are disposed between the plurality of longitudinal extending portions and disposed between the plurality of longitudinal extending portions and one or more side beams of the plurality of mounting frames, each of the one or more elastic modules comprises an upper cover and a base, the upper cover is used as a supporting surface, the base is used as a connecting end to be connected to a corresponding one of the plurality of mounting frames, the base comprises a sliding path, the plurality of longitudinal extending portions comprise a plurality of mounting portions, each of the plurality of mounting portions comprises a mounting sliding rail and a positioning portion to enable a corresponding one of the one or more elastic modules to be positioned at a mount position, a distance between two adjacent mounting sliding rails of two adjacent mounting portions of the plurality of mounting portions on the mounting rack is greater than a size of the upper cover of the corresponding one of the one or more elastic modules, the sliding path cooperates with and is positioned at the mounting sliding rail of a corresponding one of the plurality of mounting portions to enable the corresponding one of the one or more elastic modules to be detachably mounted on the corresponding one of the plurality of mounting frames, a first side beam of the one or more side beams on a first mounting frame of the plurality of mounting frames comprises at least one of a first positioning protrusion or a first positioning groove, a second side beam of the one or more side beams on a second mounting frame of the plurality of mounting frames comprises at least one of a second positioning protrusion or a second positioning groove, and the at least one of the first positioning protrusion or the first positioning groove on the first side beam and the at least one of the second positioning protrusion or the second positioning groove on the second side beam cooperate with each other to enable the plurality of mounting frames to be detachably connected to each other.

* * * * *